US009244374B2

(12) United States Patent
Sugiyama et al.

(10) Patent No.: US 9,244,374 B2
(45) Date of Patent: Jan. 26, 2016

(54) IMAGE FORMING APPARATUS

(71) Applicants: Hiroyuki Sugiyama, Kanagawa (JP); Ryoh Tanoue, Kanagawa (JP); Masahiko Shakuto, Kanagawa (JP); Tomoko Takahashi, Kanagawa (JP); Yoshinori Nakagawa, Kanagawa (JP); Ryuji Yoshida, Kanagawa (JP); Taichi Urayama, Kanagawa (JP); Shotaro Hoshi, Kanagawa (JP); Ryusuke Mase, Kanagawa (JP); Takamasa Ozeki, Kanagawa (JP)

(72) Inventors: Hiroyuki Sugiyama, Kanagawa (JP); Ryoh Tanoue, Kanagawa (JP); Masahiko Shakuto, Kanagawa (JP); Tomoko Takahashi, Kanagawa (JP); Yoshinori Nakagawa, Kanagawa (JP); Ryuji Yoshida, Kanagawa (JP); Taichi Urayama, Kanagawa (JP); Shotaro Hoshi, Kanagawa (JP); Ryusuke Mase, Kanagawa (JP); Takamasa Ozeki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/531,413

(22) Filed: Nov. 3, 2014

(65) Prior Publication Data

US 2015/0139668 A1 May 21, 2015

(30) Foreign Application Priority Data

Nov. 15, 2013 (JP) ..... 2013-236765

(51) Int. Cl.
*G03G 15/00* (2006.01)
*G03G 15/02* (2006.01)

(52) U.S. Cl.
CPC ..... *G03G 15/0266* (2013.01)

(58) Field of Classification Search
CPC ..... G03G 15/0266
USPC ..... 399/50, 48, 56, 60
See application file for complete search history.

(56) References Cited

U.S. PATENT DOCUMENTS

| | | | | |
|---|---|---|---|---|
| 8,107,839 | B2 * | 1/2012 | Miyaji et al. | 399/50 |
| 2004/0218940 | A1 | 11/2004 | Kosugi et al. | |
| 2005/0078969 | A1 * | 4/2005 | Kikuchi | |
| 2005/0095017 | A1 * | 5/2005 | Kikuchi | |
| 2011/0058832 | A1 | 3/2011 | Suzuki et al. | |
| 2013/0195480 | A1 * | 8/2013 | Kondo | |
| 2014/0064756 | A1 | 3/2014 | Sugiyama et al. | |

FOREIGN PATENT DOCUMENTS

| | | | |
|---|---|---|---|
| JP | 02271370 A | * | 11/1990 |
| JP | 5-323787 | | 12/1993 |
| JP | 08087160 A | * | 4/1996 |
| JP | 08227187 A | * | 9/1996 |

(Continued)

*Primary Examiner* — Susan Lee
(74) *Attorney, Agent, or Firm* — Oblon, McClelland, Maier & Neustadt, L.L.P.

(57) ABSTRACT

The image forming apparatus includes a process unit, a latent image writer, a power source, and a controller. The process unit is detachably attachable relative to the image forming apparatus and includes, as a single integrated unit, a latent image bearing member to bear a latent image on a surface thereof, a charging device to charge the surface of the latent image bearing member, and a development device to develop the latent image with toner. The controller causes the power source to output a charging bias at a predetermined target level supplied to the charging device. The process unit includes a first storage device to store correction information for calculating the predetermined target level of the charging bias in accordance with a combination of the latent image bearing member and the charging device. The controller corrects the predetermined target level based on the correction information in the first storage device.

9 Claims, 11 Drawing Sheets

(56) References Cited

FOREIGN PATENT DOCUMENTS

| | | | |
|---|---|---|---|
| JP | 2006011173 A * | 1/2006 | |
| JP | 2006-106692 | 4/2006 | |
| JP | 2007-179023 | 7/2007 | |
| JP | 2007-304524 | 11/2007 | |

* cited by examiner

IMAGE FORMING APPARATUS

CROSS-REFERENCE TO RELATED APPLICATIONS

This patent application is based on and claims priority pursuant to 35 U.S.C. §119 to Japanese Patent Application No. 2013-236765, filed on Nov. 15, 2013, in the Japan Patent Office, the entire disclosure of which is hereby incorporated by reference herein.

BACKGROUND

1. Technical Field

Exemplary aspects of the present disclosure generally relate to a detachably attachable process unit including, as a single integrated unit, a latent image bearing member, a charging device that charges a surface of the latent image bearing member, and a development device, and an image forming apparatus including the process unit.

2. Description of the Related Art

In known electrophotographic image forming apparatuses, a charging device uniformly charges a surface of a photosensitive member as a latent image bearing member, and an optical writer projects a light beam onto the charged surface of the photosensitive member to form an electrostatic latent image on the photosensitive member. A development device develops the electrostatic latent image formed on the photosensitive member with toner to render the electrostatic latent image visible as a toner image. Subsequently, the toner image is directly transferred from the photosensitive member onto a recording medium or is indirectly transferred from the photosensitive member onto a recording medium via an intermediate transfer member.

The charging device of the image forming apparatuses of this kind includes a charging roller to which a charging bias is applied. Electrical discharge occurs between the charging roller and the photosensitive member, thereby charging uniformly the surface of the photosensitive member. The charging device, the photosensitive member, and the development device are held as an integrated single unit by a common holder and are detachably attachable as a single integrated unit relative to a main body of the image forming apparatus.

When a charge potential of the photosensitive member deviates significantly from a target value, a background potential (i.e., a potential difference between a potential of a non-image formation area of the photosensitive member and a surface potential of a development member (i.e., a development roller) of the development device) development bias and a dark portion potential) becomes too much or too little, causing imaging failure. When the background potential is insufficient, the toner on the development member of the development device moves undesirably to the non-image formation area or a background portion of the photosensitive surface, resulting in undesirable toner adhesion onto a recording medium. This contamination of the non-image formation area of the surface of the photosensitive member is hereinafter referred to as background fogging.

In a case in which the image forming apparatus employs a two-component development method using a two-component developer including toner and magnetic carrier, with an excess background potential, the magnetic carrier on the development member moves to the surface of the photosensitive member undesirably. This is known as carrier adhesion.

In view of the above, it is necessary to control the charge potential of the photosensitive member to attain the target value. However, in the image forming apparatus using a plurality of process units for different colors, the charging bias to attain the target charge potential for the photosensitive member varies between the process units. More specifically, the thickness of the surface layer of the photosensitive member varies between the photosensitive members in the process units. Furthermore, the electrical resistance of the charging roller also varies between the charging rollers in the process units. Due to these variations, a discharge start voltage between the charging roller and the photosensitive member also varies between the process units. As a result, the charging bias to charge the surface of the photosensitive member to a target voltage, for example, −700V, varies between the process units.

If all the process units employ the same charging bias, the charge potential of the photosensitive member may deviate significantly from the target value depending on the process unit, resulting in the background fogging and carrier adhesion onto the photosensitive member. In particular, in order to realize cost savings, the charging bias may consist only of a direct-current component. In such a case, the discharge start voltage between the charging roller and the photosensitive member is affected significantly by the charge potential of the photosensitive member. The variations in the discharge start voltage between the process units easily cause the background fogging and carrier adhesion to the photosensitive member.

In view of the above, there is demand for an image forming apparatus that is capable of preventing the background fogging and carrier adhesion derived from variations in the discharge start voltage between the process units.

SUMMARY

In view of the foregoing, in an aspect of this disclosure, there is provided an improved (or novel) image forming apparatus including a process unit, a latent image writer, a power source, and a controller. The process unit is detachably attachable relative to a main body of the image forming apparatus and includes, as a single integrated unit, a latent image bearing member to bear a latent image on a surface thereof, a charging device to charge the surface of the latent image bearing member, and a development device to develop the latent image on the surface of the latent image bearing member with toner to form a toner image. The latent image writer writes the latent image on the surface of the latent image bearing member charged by the charging device. The power source outputs a charging bias supplied to the charging device. The controller is operatively connected to the power source to cause the power source to output the charging bias at a predetermined target level. The process unit further includes a first storage device to store correction information for calculating the predetermined target level of the charging bias in accordance with a combination of the latent image bearing member and the charging device. The controller corrects the predetermined target level based on the correction information stored in the first storage device.

According to another aspect, an image forming apparatus includes a process unit, a latent image writer, a power source, and a controller. The process unit is detachably attachable relative to a main body of the image forming apparatus, and the process unit separably includes, as a single integrated unit, an image bearer unit and a development unit. The image bearer unit includes a latent image bearing member to bear a latent image on a surface thereof and a charging device to charge the surface of the latent image bearing member. The development unit includes a development device to develop the latent image on the surface of the latent image bearing member with toner to form a toner image and a toner density detector to detect a toner density of a development agent in the development device. The toner density detector includes a memory circuit to store correction information for correcting a target charging bias in accordance with the process unit. The latent image writer writes the latent image on the surface of the latent image bearing member charged by the charging device. The power source outputs a charging bias supplied to the charging device. The controller is operatively connected to a predetermined device associated with a predetermined control parameter based on a target value of the predetermined control parameter. In a case in which the process unit is detached from and attached to the main body of the image forming apparatus, the controller determines whether or not to rewrite one of the correction information and the predetermined calculation result stored in a storage device of the main body of the image forming apparatus with a value stored in the memory circuit of the toner density detector based on the correction information stored in the memory circuit and one of the correction information and a predetermined calculation result based on the correction information stored in a storage device of the controller. In a case in which the correction information stored in the memory circuit includes a predetermined value, the controller determines not to rewrite regardless of a result in which the controller determines to rewrite based on the correction information stored in the memory circuit and one of the correction information and the predetermined calculation result stored in the storage device of the controller.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
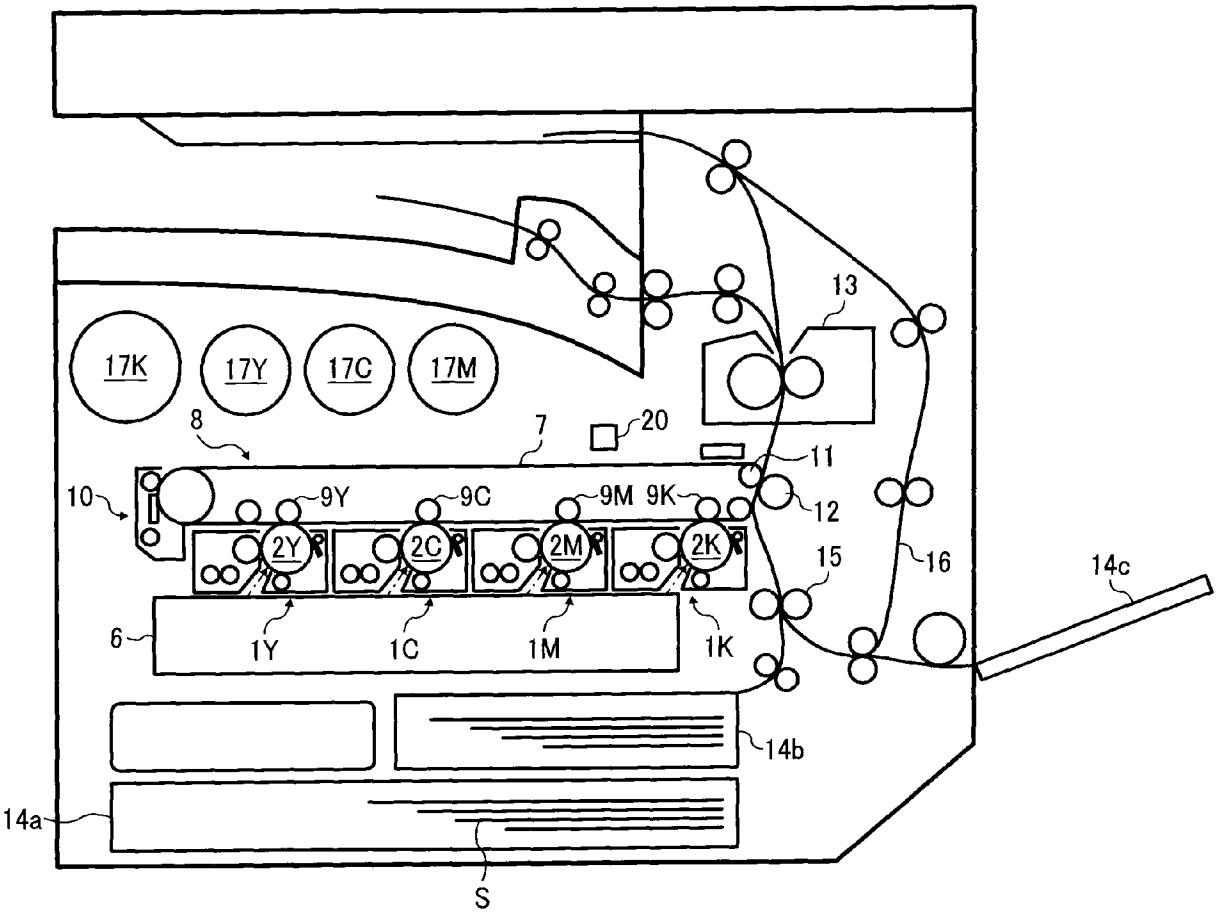
FIG. 1 is a schematic diagram illustrating a printer as an example of an image forming apparatus, according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

With reference to FIG. 1, a description is provided of an electrophotographic color copier as an example of an image forming apparatus according to an illustrative embodiment of the present disclosure. As illustrated in FIG. 1, the image forming apparatus is a printer and includes four process units 1Y, 1C, 1M, and 1K (which may be collectively referred to as process units 1) for performing an electrophotographic process to form toner images of yellow, magenta, cyan, and black, respectively. It is to be noted that the suffixes Y, M, C, and K denote colors yellow, magenta, cyan, and black, respectively. To simplify the description, these suffixes are omitted herein, unless otherwise specified. The order of arrangement of the process units 1Y, 1C, 1M, and 1K is not limited to the configuration described above.

Figure 2:
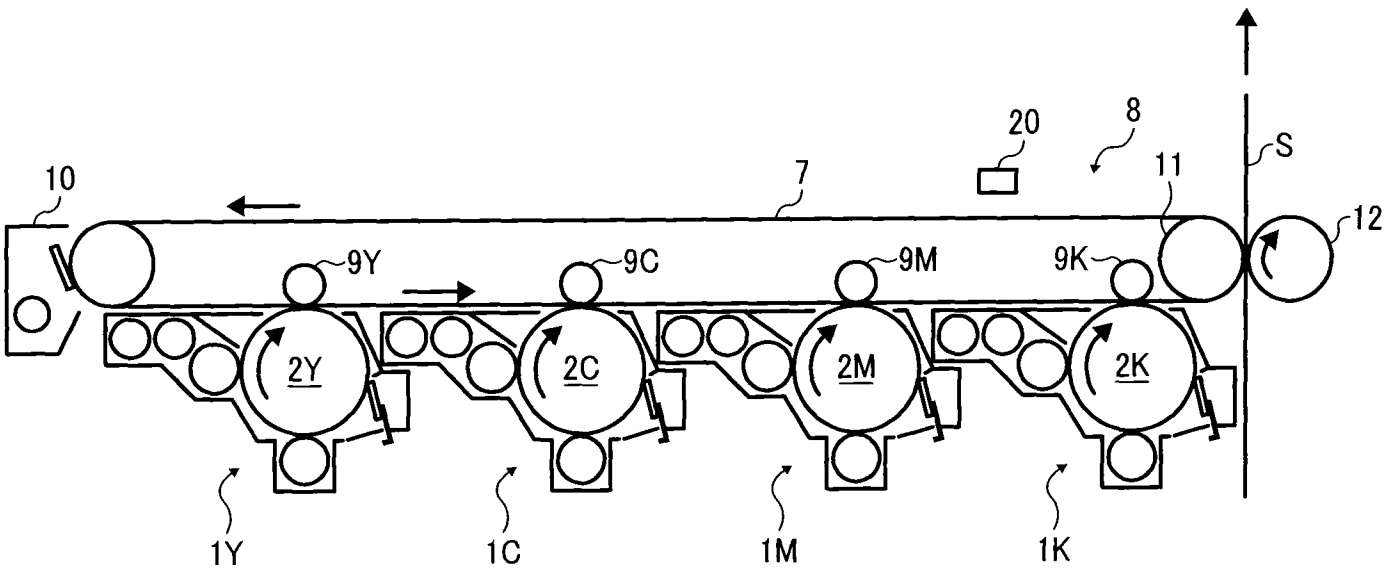
FIG. 2 is a schematic diagram illustrating four process units and a transfer device employed in the image forming apparatus of FIG. 1.

FIG. 2 is a schematic diagram illustrating four process units 1Y, 1C, 1M, and 1K, and a transfer device 8 employed in the image forming apparatus of FIG. 1. The process units 1Y, 1C, 1M, and 1K include drum-shaped photosensitive members (hereinafter referred to simply as photosensitive drums) 2Y, 2C, 2M, and 2K, respectively. The photosensitive drums 2Y, 2C, 2M, and 2K rotate in a clockwise direction, and toner images of yellow, cyan, magenta, and black are formed on the surface of the photosensitive drums 2Y, 2C, 2M, and 2K, respectively.

As illustrated in FIG. 2, the transfer device 8 is disposed substantially above the image forming units 1Y, 1C, 1M, and 1K. The transfer device 8 includes an intermediate transfer belt 7 formed into an endless loop, entrained around and stretched taut between a plurality of rollers. The intermediate transfer belt 7 travels endlessly in a counterclockwise direction indicated by an arrow in FIG. 2. The place at which the outer surface or the front surface (image bearing surface) of the intermediate transfer belt 7 faces and contacts the photosensitive drums 2Y, 2M, 2C, and 2K is a so-called primary transfer nip. The intermediate transfer belt 7 is interposed between the photosensitive drums 2Y, 2M, 2C, and 2K, and primary transfer rollers 9Y, 9C, 9M, and 9K disposed inside the looped intermediate transfer belt 7, thereby forming reliably the primary transfer nips for the colors yellow, cyan, magenta, and black, respectively.

The intermediate transfer belt 7 is entrained around a plurality of rollers, one of which is a drive roller to rotate the intermediate transfer belt 7 endlessly in the counterclockwise direction. The transfer unit 8 includes the intermediate transfer belt 7, the primary transfer rollers 9Y, 9C, 9M, and 9K, a cleaning device 10 including a brush roller and a cleaning blade, a secondary-transfer auxiliary roller 11, a secondary transfer roller 12, an optical detector unit 20, and so forth.

A primary transfer bias having a polarity opposite to a charge polarity of toner is applied to the primary transfer rollers 9Y, 9C, 9M, and 9K by a transfer power source. With this configuration, a primary transfer electric field that electrostatically transfers toner images of yellow, cyan, magenta, and black from the photosensitive drums 2Y, 2C, 2M, and 2K to the intermediate transfer belt 7 is formed at the respective primary transfer nips. The intermediate transfer belt 7 travels endlessly and passes through the primary transfer nips of yellow, magenta, cyan, and black, accordingly. The toner images on the photosensitive drums 2Y, 2C, 2M, and 2K are primarily transferred onto the intermediate transfer belt 7 such that they are superimposed one atop the other, thereby forming a four-color composite toner image on the outer surface of the intermediate transfer belt 7 in the primary transfer process.

A secondary transfer roller 12 is disposed at the right side of the intermediate transfer belt 7 and contacts the outer surface of the intermediate transfer belt 7, thereby forming a secondary transfer nip between the secondary transfer roller 12 and the intermediate transfer belt 7. The intermediate transfer belt 7 is interposed between the secondary transfer roller 12 and the secondary-transfer auxiliary roller 11 disposed inside the looped intermediate transfer belt 7, thereby forming reliably the secondary transfer nip between the intermediate transfer belt 7 and the secondary transfer roller 12.

Figure 3:
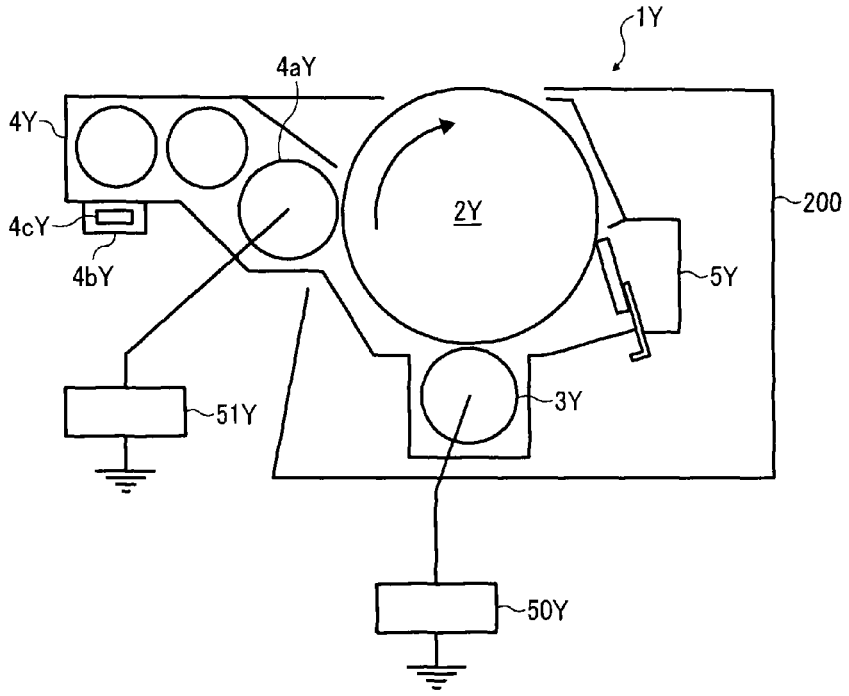
FIG. 3 is a schematic diagram illustrating a process unit for yellow color as an example of the process units employed in the image forming apparatus.

FIG. 3 is a schematic diagram illustrating the process unit 1Y for yellow color as an example of the process units employed in the image forming apparatus. As illustrated in FIG. 1, in the process unit 1Y, the photosensitive drum 2Y is surrounded by a charging device including a charging roller 3Y, a development device 4Y, a cleaning device 5Y, and so forth. The charging roller 3Y is a rubber roller and contacts the surface of the photosensitive drum 2Y while rotating.

According to the present illustrative embodiment, a contact-type direct-current (DC) charging method is employed. In the contact-type DC charging method, a charging bias including a DC bias without an alternating current (AC) component is applied to the charging roller 3Y. Alternatively, other charging methods such as a charging method using a contact-type AC charging roller and a contact-free charging method may be employed.

The development device 4Y contains a two-component developer including yellow toner and magnetic carrier. The average particle diameter of the yellow toner is in a range from approximately 4.9 μm to 5.5 μm. The magnetic carrier is small-diameter, low-resistance carrier having the bridge resistance equal to or less than approximately 12.1 LogΩ·cm. The development device 4Y includes a development roller 4*a*Y as a developer bearing member facing the photosensitive drum 2Y, a screw to deliver and mix the developer, and a toner density detector 4*b*Y, and so forth. The development roller 4*a*Y includes a development sleeve made of a pipe which is rotatable, and a magnetic roller disposed inside the development sleeve such that the magnetic roller does not rotate together with the development sleeve.

The photosensitive drum 2Y and surrounding devices such as the charging device 3Y, the development device 4Y, the cleaning device 5Y, and the development device 4Y are held as a single integrated unit, that is, as the process unit 1Y, by a common holder and detachably attachable as a single integrated unit relative to a main body of the image forming apparatus, thereby facilitating maintenance as compared with a configuration in which the photosensitive drum 2Y, the charging device 3Y, the development device 4Y, the cleaning device 5Y, and the development device 4Y are detached and attached individually. Other process units 1C, 1M, and 1K have the similar or the same configuration as the process unit 1Y, except for the color of toner employed.

Referring back to FIG. 1, a description is provided of an optical writing unit 6. The optical writing unit 6 serving as a latent image writer for writing a latent image on each of the photosensitive drums 2Y, 2C, 2M, and 2K is disposed below the process units 1Y, 1C, 1M, and 1K. The optical writing unit 6 includes a light source, a polygon mirror, an f-θ lens, a reflective mirror, and so forth, and illuminates the surfaces of the photosensitive drums 2Y, 2C, 2M, and 2K with laser light based on image data. Accordingly, the electrostatic latent images of yellow, cyan, magenta, and black are formed on the photosensitive drums 2Y, 2C, 2M, and 2K, respectively.

A fixing device 13 is disposed above the secondary transfer roller 12. The fixing device 13 includes a fixing roller and a pressure roller which contact each other while rotating, thereby forming a fixing nip. The fixing roller includes a halogen heater inside thereof. Power is supplied to the fixing roller by a power source to heat the surface of the fixing roller at a predetermined temperature. The fixing roller and the pressure roller contact to form a fixing nip therebetween.

Paper cassettes 14*a* and 14*b*, a paper feed roller, a pair of registration rollers 15, and so forth are disposed substantially at the bottom of the main body of the image forming apparatus. The paper cassettes 14*a* and 14*b* store a stack of multiple recording media S. An output image is recorded on the recording medium S. At the lateral side of the image forming apparatus, a side tray 14*c* is disposed to feed a recording medium S manually. At the right side of the transfer device 8 and the fixing device 13, a duplex unit 16 is disposed to deliver the recording medium S again to the secondary transfer nip upon double sided printing.

Toner supply bottles 17Y, 17C, 17M, and 17K to supply toner to the development devices of the process units 1Y, 1C, 1M, and 1K are disposed substantially at the upper portion of the image forming apparatus. A waste toner bin and a power source unit are also disposed in the main body of the image forming apparatus.

Next, a description is provided of an example of a print job. First, an electrophotographic process is initialized in the process units 1Y, 1C, 1M, and 1K. More specifically, in the process unit 1Y as a representative example of the process units, a charging-device power source 50Y outputs and applies a charging bias to the charging roller 3Y, thereby generating electrical discharge between the charging roller 3Y and the photosensitive drum 2Y. Accordingly, the surface of the photosensitive drum 2Y is charged uniformly to a negative polarity. After the surface of the photosensitive drum 2Y is charged uniformly, the optical writing unit 6 illuminates the photosensitive drum 2Y with a laser light based on the image data, thereby writing the electrostatic latent image on the photosensitive drum 2Y.

When the surface of the photosensitive drum 2Y bearing the electrostatic latent image arrives at a position opposite to the development device 4Y, the development roller 4*a*Y facing the photosensitive drum 2Y supplies yellow toner to the electrostatic latent image on the surface of the photosensitive drum 2Y, thereby forming a toner image. A toner image of yellow is formed on the photosensitive drum 2Y. In accordance with an output from the toner density detector 4*b*Y, an appropriate amount of yellow toner is supplied from the toner supply bottle 17Y to the development device 4Y.

Similar to the process unit 1Y, the above-described electrophotographic process is performed in the process units 1C, 1M, and 1K in predetermined timing. Accordingly, toner images of the colors yellow, cyan, magenta, and black are formed on the photosensitive drums 2Y, 2C, 2M, and 2K, respectively. As described above, the toner images of yellow, cyan, magenta, and black are primarily transferred onto the outer surface or the front surface of the intermediate transfer belt 7 in the respective primary transfer nips such that they are superimposed one atop the other, thereby forming a four-color toner image on the intermediate transfer belt 7.

After the print job is started, the recording medium S is fed either from the paper cassettes 14*a* and 14*b*, or from the side tray 14*c*. As the leading end of the recording medium S arrives at the pair of registration rollers 15, rotation of the pair of registration rollers 15 stops temporarily. The pair of registration rollers 15 starts to rotate again to feed the recording medium S to the secondary transfer nip in appropriate timing.

A voltage having a polarity opposite that of the toner is supplied to the secondary transfer roller 12 by a secondary-transfer power source, thereby transferring the four-color composite toner image on the intermediate transfer belt 7 onto the recording medium S in the secondary transfer nip.

After the recording medium S exits the secondary transfer nip, the recording medium S is delivered to the fixing device 13 and interposed in the fixing nip. The toner image on the recording medium S is heated by the fixing roller and fixed on the recording medium S in the fixing nip. In a case of single side printing, the recording medium S on which the toner image is fixed is discharged outside the image forming apparatus by conveyor rollers. In a case of double sided printing, the recording medium S is delivered to the duplex unit 16 by the conveyor rollers and reversed. An image is formed on a second side or an opposite side to the surface on which an image has already been formed.

Figure 4:
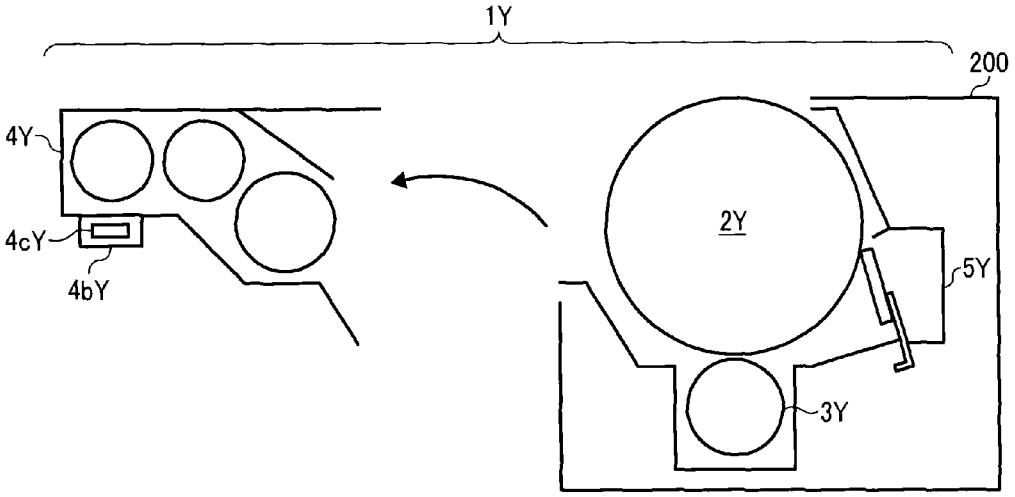
FIG. 4 is a partially enlarged diagram schematically illustrating the process unit when photosensitive drum unit for yellow color and a development unit for yellow color are separated.

FIG. 4 is a partially enlarged diagram schematically illustrating the process unit 1Y when a photosensitive drum unit including the photosensitive drum 2Y for yellow color and the development device 4Y for yellow color are separated. As illustrated in FIG. 4, the process unit 1Y is constituted of the separable photosensitive drum unit and the separable development device 4Y. As illustrated in FIG. 4, the photosensitive drum unit includes, in a casing 200, the photosensitive drum 2Y, the charging device including the charging roller 3Y, and the cleaning device 5Y.

The reason for constituting the process unit 1Y in which the development device 4Y and the photosensitive drum unit are separable from one another is as follows. The development device 4Y and the process unit 1Y are assemblies of multiple parts and are thus relatively expensive. If the process unit 1Y does not allow each part to be separable and one of the parts fails, all parts need to be detached and replaced together, which is costly. By contrast, as in the present illustrative embodiment, when the development device 4Y and the photosensitive drum unit are separable, only one of the development device 4Y and the photosensitive drum unit, whichever includes a malfunctioning part, can be replaced, thereby realizing cost savings.

It is to be noted that the process unit 1Y when installed in the main body of the image forming apparatus, the development device 4Y and the photosensitive drum unit are not separable. In order to separate, the process unit 1Y needs to be detached from the main body of the image forming apparatus. Similarly, the same configuration as the process unit 1Y is applied to the process units 1C, 1M, and 1K.

Figure 5A:
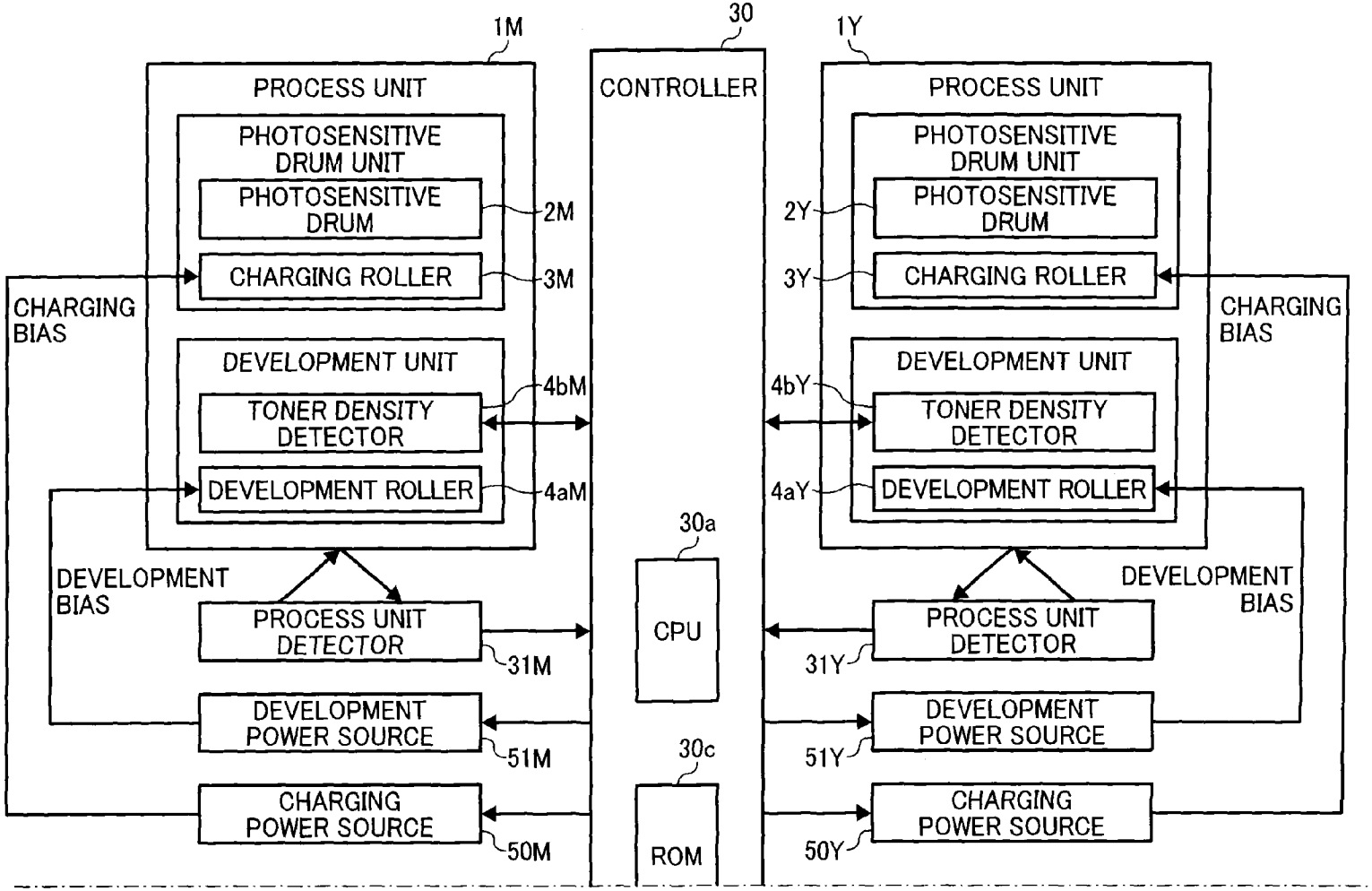
FIGS. 5A through 5C are block diagrams illustrating an electrical circuit of the image forming apparatus.
Figure 5B:
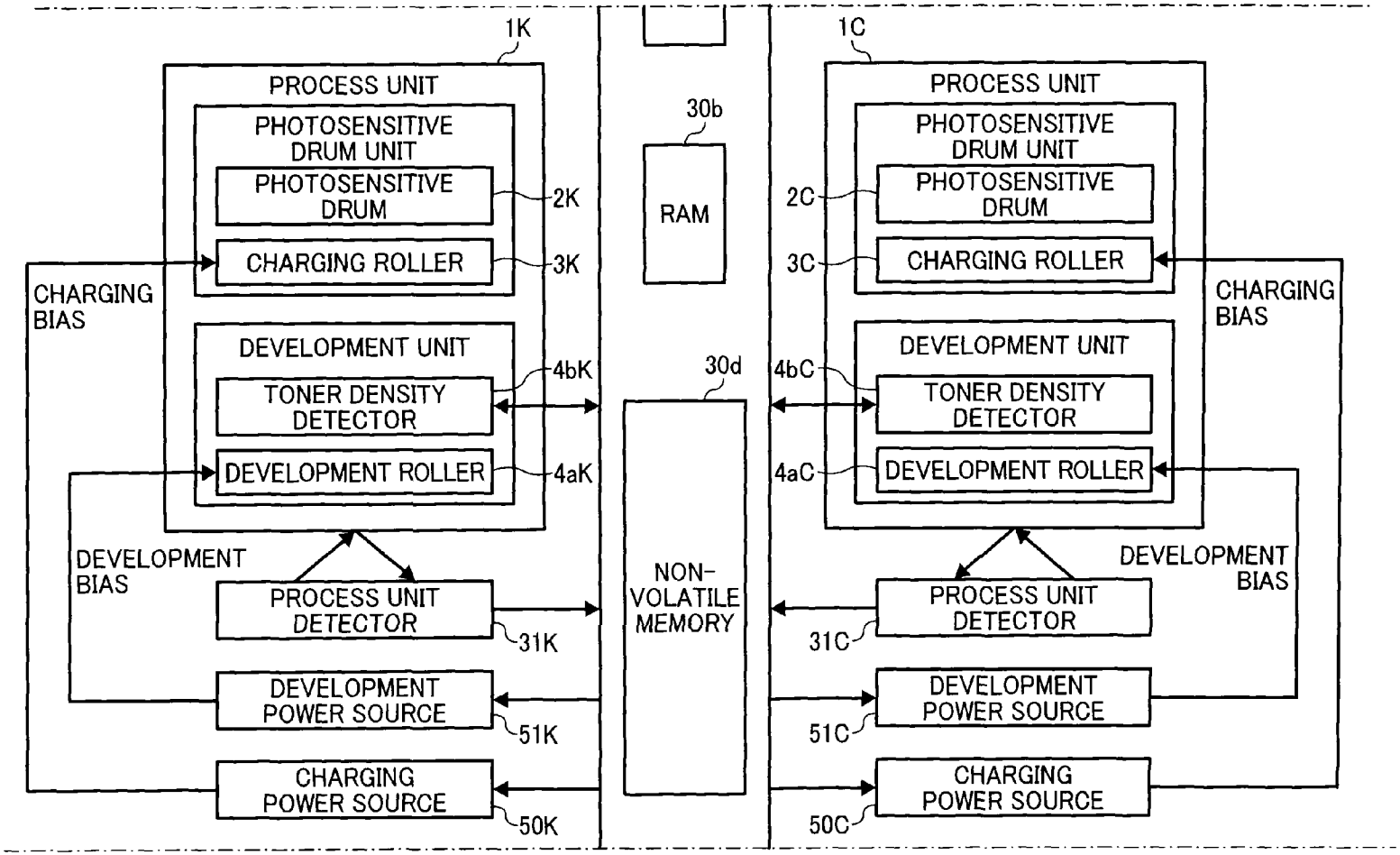
Figure 5C:
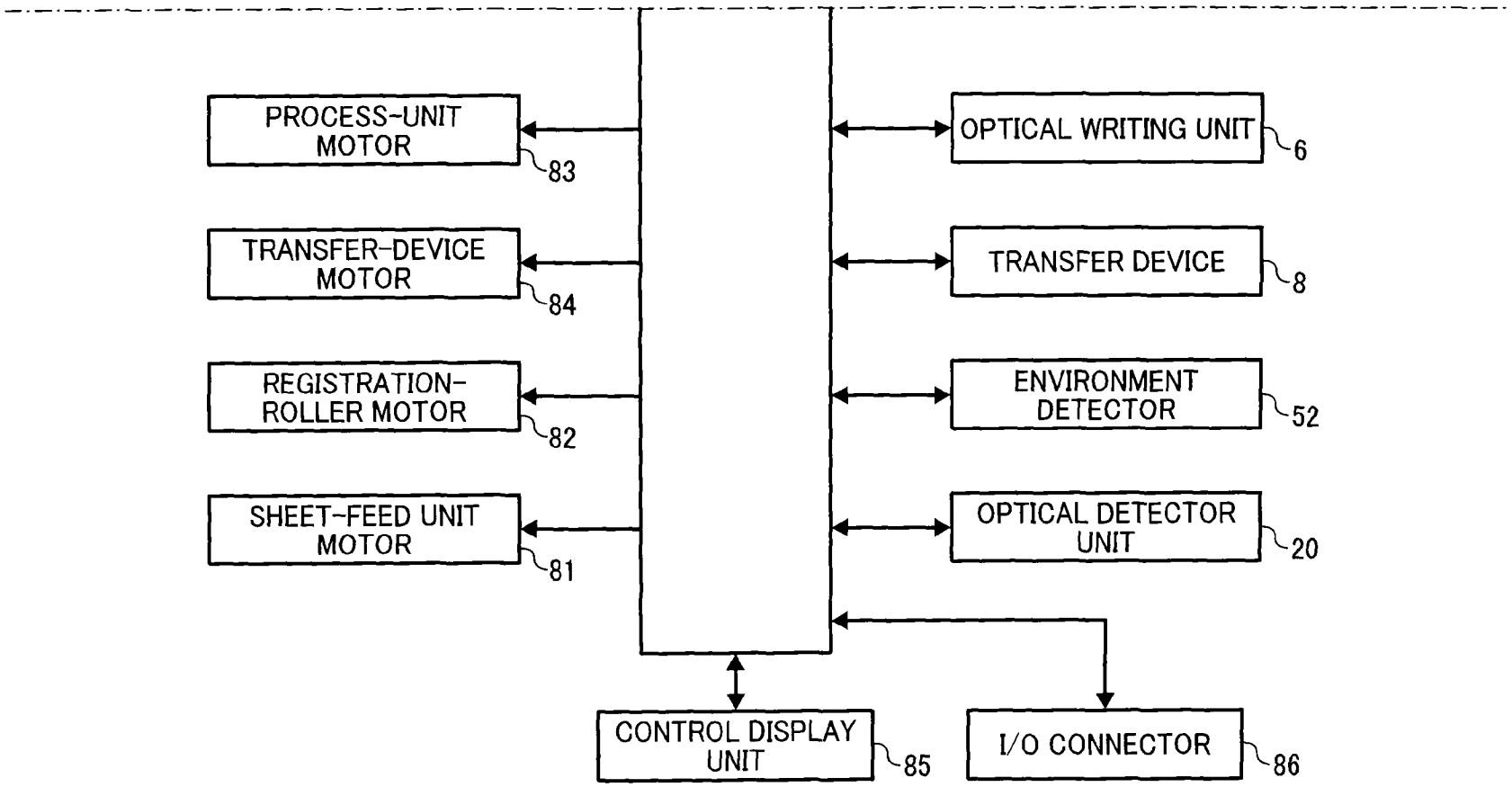

FIGS. 5A through 5C are block diagrams illustrating a portion of an electrical circuit of the image forming apparatus according to an illustrative embodiment of the present disclosure. As illustrated in FIGS. 5A through 5C, a controller 30 includes a Central Processing Unit (CPU) 30*a*, a Random Access Memory (RAM) 30*b*, and a Read Only Memory (ROM) 30*c*, a non-volatile memory, and so forth. Toner density detectors 4*b*Y, 4*b*C, 4*b*M, and 4*b*K are electrically connected to the controller 30 so that the controller 30 can recognize the density of yellow developer, cyan developer, magenta developer, and black developer stored in the development devices of the respective color and read information stored in a memory circuit of the toner density detectors 4*b*Y, 4*b*C, 4*b*M, and 4*b*K.

Process unit detectors 31Y, 31C, 31M, and 31K are electrically connected to the controller 30 to detect attachment and detachment of the process units 1Y, 1C, 1M, and 1K relative to the main body of the image forming apparatus. Accordingly, the controller 30 can recognize installation and detachment of the process units 1Y, 1C, 1M, and 1K relative to the main body of the image forming apparatus.

Development-device power sources 51Y, 51C, 51M, and 51K are electrically connected to the controller 30. The controller 30 outputs control signals individually to the development-device power sources 51Y, 51C, 51M, and 51K to adjust individually a development bias output from the development-device power sources 51Y, 51C, 51M, and 51K.

Charging-device power sources 50Y, 50C, 50M, and 50K are electrically connected to the controller 30. The controller 30 outputs control signals individually to the charging-device power sources 50Y, 50C, 50M, and 50K to adjust individually a charging bias output from the charging-device power sources 50Y, 50C, 50M, and 50K.

The optical writing unit 6, the transfer device 8, an environment detector 52, the optical detector unit 20, a process-unit motor 83, a transfer-device motor 84, a registration-roller motor 82, a paper feed motor 81, and so forth are also connected electrically to the controller 30. The environment detector 52 detects temperature and humidity inside the image forming apparatus. The process-unit motor 83 serves as a drive source to drive the process units 1Y, 1C, 1M, and 1K. The transfer-device motor 84 serves as a drive source to drive the intermediate transfer belt 7. The registration-roller motor 82 serves as a drive source to drive the pair of registration rollers 15. The paper feed motor 81 serves as a drive source to drive a pickup roller to pickup a recording medium S from the paper cassette 14*a*. A description of the optical detector unit 20 will be provided later.

According to the present illustrative embodiment, in order to stabilize image quality even when there is a change in environment conditions and after extended use, a so-called process control is performed at predetermined timing. More specifically, in the process control for yellow color, for example, a plurality of yellow test toner patterns consisting of a plurality of yellow toner patches is formed on the photosensitive drum 2Y and is transferred onto the intermediate transfer belt 7. Similarly, a plurality of test toner patterns for cyan, magenta, and black is formed on the photosensitive drums 2C, 2M, and 2K. The optical detector unit 20 detects a toner adhesion amount of each test toner pattern, and based on the detection result imaging conditions including but not limited to the development bias Vb are adjusted.

The optical detector unit 20 includes a plurality of reflective-type photosensors arranged with a predetermined interval between each other in a width direction of the intermediate transfer belt 7. Each of the photosensors outputs a signal in accordance with an optical reflectance of the intermediate transfer belt 7 and the test toner patterns on the intermediate transfer belt 7. Four reflective-type photosensors are provided in the present illustrative embodiment.

In order to output a signal in accordance with the toner images of yellow, magenta, and cyan, and the toner adhesion amount of the test toner patterns of yellow, magenta, and cyan, three photosensors among four photosensors detect both specular reflection light and diffuse reflection light on the surface of the intermediate transfer belt 7 and output the signal in accordance with intensity of the light. In order to output a signal in accordance with the toner image of black and the toner adhesion amount of the test toner pattern of black color, one photosensor other than the three photosensors above detects only the specular reflection light on the surface of the intermediate transfer belt 7 and outputs the signal in accordance with the intensity of the light.

Figure 6:
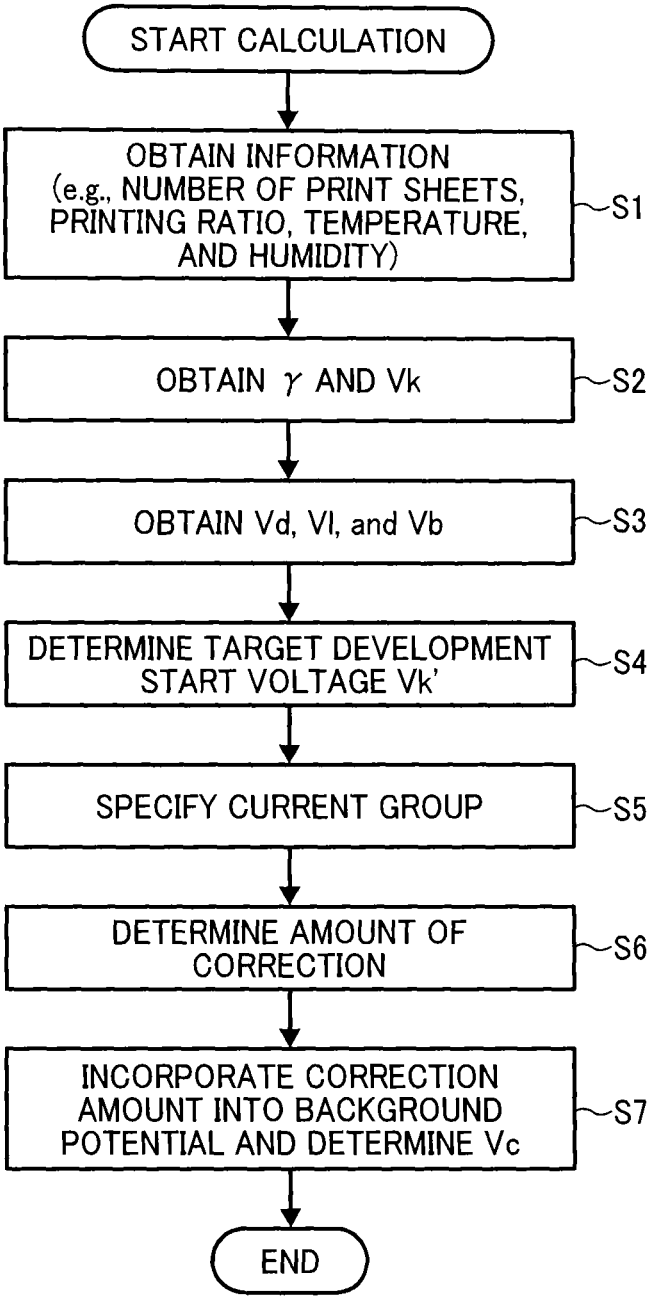
FIG. 6 is a flowchart showing steps of an arithmetic processing of process control according to an illustrative embodiment of the present disclosure.

The controller 30 carries out the process control at a predetermined timing, for example, when a main power source is turned on, or at a stand-by mode after a predetermined time elapsed, or at a stand-by mode after a predetermined number of sheets are output. FIG. 6 is a flowchart showing steps of an arithmetic processing in the process control according to an illustrative embodiment of the present disclosure. As illustrated in FIG. 6, at step S1, when the above-described time comes, the controller 30 obtains information, including but is not limited to a number of sheets passed, a coverage rate, environment information such as temperature and humidity. Next, characteristics of development in the process units 1Y, 1C, 1M, and 1K are obtained. More specifically, at step S2, a development gamma γ and a development-start voltage are calculated for each color. The photosensitive drums 2Y, 2C, 2M, and 2K are rotated and charged uniformly. When charging the photosensitive drums 2Y, 2C, 2M, and 2K, an absolute value of the charging bias is increased, as compared with a charging bias Vc which remains unchanged at normal printing (for example, −1400 V).

The optical writing unit 6 illuminates the photosensitive drums 2Y, 2C, 2M, and 2K with laser light to form electrostatic latent images for the test toner patterns of yellow, cyan, magenta, and black on the photosensitive drums 2Y, 2C, 2M, and 2K, respectively. The electrostatic latent images are developed with a respective color of toner by the development devices 4Y, 4C, 4M, and 4K, thereby forming the test toner patterns for yellow, cyan, magenta, and black. Upon development, the controller 30 increases gradually an absolute value of a development bias Vb to be applied to the development rollers 4*a*Y, 4*a*C, 4*a*M, and 4*a*K. The development bias Vb and the charging bias Vc include a direct current bias having a negative polarity.

Figure 7:
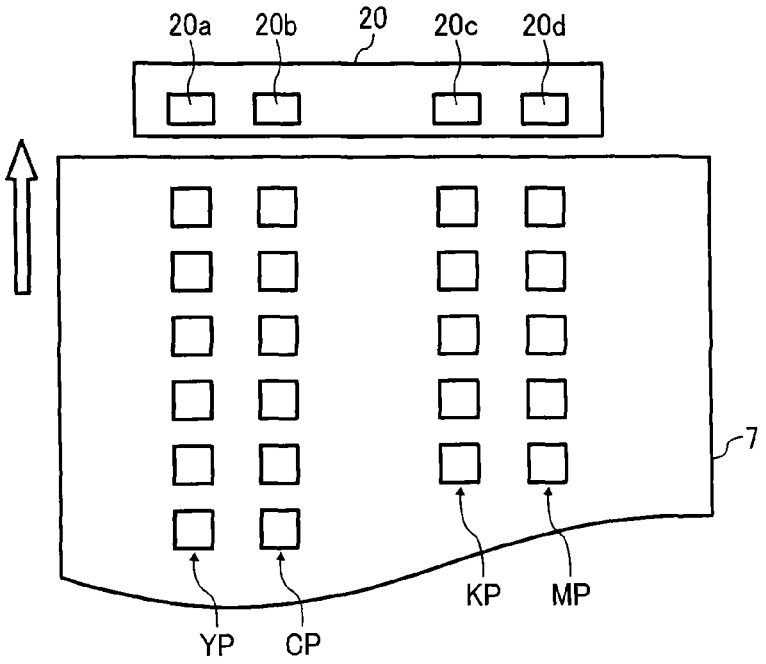
FIG. 7 is a schematic diagram illustrating a patch pattern image on an intermediate transfer belt.

As illustrated in FIG. 7, the test toner patterns of yellow, cyan, magenta, and black are transferred in such a manner that they are not superimposed one atop the other on the intermediate transfer belt 7, but arranged in the belt width direction. More specifically, yellow test toner patterns YP are transferred on an end of the intermediate transfer belt 7 in the width direction of the intermediate transfer belt 7. Cyan test toner patterns CP are transferred onto the intermediate transfer belt 7 a little more towards the center than the yellow test toner patterns YP. Magenta test toner patterns MP are transferred on the other end of the intermediate transfer belt 7 in the width direction. Black test toner patterns KP are transferred onto the intermediate transfer belt 7 a little more towards the center than the magenta test toner patterns MP.

The optical detector unit 20 includes a first reflective-type photosensor 20*a*, a second reflective-type photosensor 20*b*, a third reflective-type photosensor 20*c*, and a fourth reflective-type photosensor 20*d* to detect characteristics of light reflection at different positions on the intermediate transfer belt 7 in the width direction thereof. The third reflective-type photosensor 20*c* detects only the specular reflection light so that changes in the characteristics of the light reflection on the belt surface associated with adhesion of the black toner are detected. Other reflective-type photosensors, i.e., 20*a*, 20*b*, and 20*d* detect both the specular reflection light and the diffuse reflection light to detect changes in the characteristics of the light reflection on the belt surface associated with adhesion of yellow, cyan, and magenta toner.

The first reflective-type photosensor 20*a* is disposed at such a position that the first reflective-type photosensor 20*a* detects the toner adhesion amount of the yellow test toner patterns YP formed on one end of the intermediate transfer belt 7 in the belt width direction. The second reflective-type photosensor 20*b* is disposed at such a position that the second reflective-type photosensor 20*b* detects the toner adhesion amount of the cyan test toner patterns CP formed near the yellow test toner pattern YP in the belt width direction. The fourth reflective-type photosensor 20*d* is disposed at such a position that the fourth reflective-type photosensor 20*d* detects the toner adhesion amount of the magenta test toner patterns MP formed on the other end of the intermediate transfer belt 7 in the belt width direction. The third reflective-type photosensor 20*c* is disposed at such a position that the third reflective-type photosensor 20*c* detects the toner adhesion amount of the black test toner patterns KP formed near the magenta test toner pattern MP in the width direction. It is to be noted that the first reflective-type photosensor 20*a*, the second reflective-type photosensor 20*b*, and the fourth reflective-type photosensor 20*d* can detect the toner adhesion amount of the test toner patterns of any color (i.e., yellow, cyan, magenta), except black.

Based on an output signal provided by the four reflective-type photosensors of the optical detector unit 20, the controller 30 calculates the optical reflectance of the test toner patterns for each color. Subsequently, based on the calculation result, the controller 30 obtains the toner adhesion amount and stores the value thus obtained in the RAM 30*a*. It is to be noted that the test toner patterns for each color that have passed by the optical detector unit 20 as the intermediate transfer belt 7 travels are removed or cleaned by the cleaning device 10.

Figure 8:
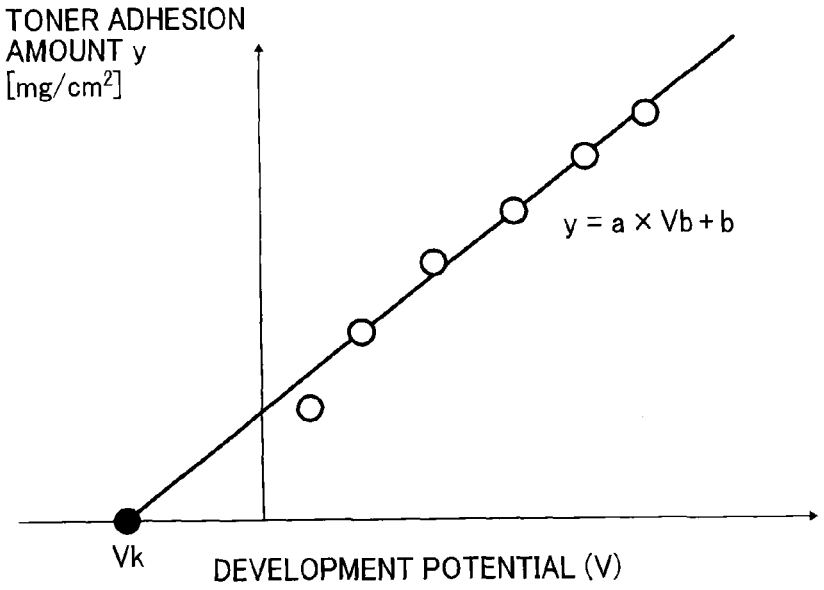
FIG. 8 is a graph showing relations between a development potential and a toner adhesion amount.

Next, the controller 30 obtains a linear approximation (y=a×Vb+b) shown in FIG. 8 using the image density data (toner adhesion amount) stored in the RAM 30*a* and an exposure potential (latent image potential) data stored in the RAM 30*b*. In a two-dimensional coordinate shown in FIG. 8, an X-axis represents a development potential (V1−Vb) which is the difference between the exposure potential V1 and the development bias Vb applied at this time. A Y-axis represents a toner adhesion amount (y) per unit area.

In FIG. 8, the data corresponding to the number of test toner patterns is plotted on an X-Y plane. Based on the plurality of plotted data, an interval on the X-Y plane on which the linear approximation is performed is determined. Subsequently, within the interval thus obtained, the linear approximation (y=a×Vb+b) is obtained by the method of least squares. Based on the linear approximation, the development gamma γ and the development start voltage Vk are calculated. The development gamma γ is obtained as a slope of the linear approximation (γ=a), and the development start voltage Vk is obtained as an intersection of the linear approximation and the X-axis. Accordingly, at Step S2, the development characteristics for the process units 1Y, 1C, 1M, and 1K are obtained.

Next, at Step S3, based on the development characteristics thus obtained, the controller 30 obtains a target value (target charge potential) of the charge potential (background potential) Vd, a target value (target exposure potential) of the exposure potential V1, and the development bias Vb. More specifically, the target charge potential and the target exposure potential are obtained based on a table in which relations between the development gamma γ, the charge potential Vd, and the exposure potential V1 are predetermined. With this configuration, the target charge potential and the target exposure potential suitable for the development gamma γ are selected.

The development bias Vb is obtained as follows. The development potential for obtaining a maximum toner adhesion amount is obtained in accordance with a combination of the development gamma γ and the development start voltage Vk, and the development bias Vb for obtaining such a development potential is obtained. Subsequently, based on the development bias thus obtained and the background potential, the target charge potential is obtained. Because the surface of the development sleeve of the development roller has a similar or the same value as the development bias Vb, the target development potential and the background potential can be obtained as long as the surface of the photosensitive drum is charged to the target charge potential and exposed properly.

Next, the controller 30 determines the charging bias Vc. More specifically, the charge potential Vd is influenced by the discharge start voltage between the charging roller and the photosensitive drum. When using the charging bias consisting only of the DC bias such as in the image forming apparatus of the present disclosure, as described above, the slope "a" of the graph of FIG. 11 becomes almost one (1). Consequently, by applying the charging bias Vc, which is a sum of the target charge potential and the discharge start voltage, to the charging roller, the charge potential Vd can be made closed to the target charge potential.

It is to be noted that even when employing the same process units, the discharge start voltage fluctuates over time due to a degree of deterioration of the surface of the photosensitive drum, an electrical resistance of the charging roller influenced by the environment, and so forth. The controller 30 stores an algorithm for the discharge start voltage for obtaining a theoretical value Vs of the discharge start voltage based on a combination of the environment (temperature and humidity) and a travel distance of the photosensitive drum. The algorithm for the discharge start voltage is formulated based on an experiment performed in advance. Using the temperature and humidity detected by the environment detector 52, the travel distance of the photosensitive drum stored in the non-volatile memory 30*d*, and the algorithm for the discharge start voltage, the controller 30 obtains the theoretical value Vs of the discharge start voltage.

The sum of the target charge potential and the theoretical value Vs of the discharge start voltage is determined as the charging bias Vc. That is, a solution of a formula "Vc=Vs+Target Charge Potential" is set as a target value for the charging bias Vc. As will be described later, in reality, the obtained theoretical value Vs of the discharge start voltage using the algorithm for the discharge start voltage is corrected by adding a later-described correction value. After the correction, the charging bias is obtained by substituting the theoretical value Vs of the discharge start voltage into the above formula.

The ROM 30*c* stores an algorithm representing relations between a control signal output to the charging-device power sources 50Y, 50C, 50M, and 50K, and the charging bias Vc output from the charging-device power sources 50Y, 50C, 50M, and 50K. In a print job, the controller 30 obtains, using the algorithm, a control signal that enables the target charging bias Vc to be output. The controller 30 outputs the control signal thus obtained to the charging-device power sources 50Y, 50C, 50M, and 50K. With this configuration, the charging-device power sources 50Y, 50C, 50M, and 50K output the charging bias Vc similar to the target value or almost the same as the target value.

The developer has such a characteristic that the background fogging or contamination of the non-image formation area of the surface of the photosensitive member with toner is more pronounced after extended use than at the initial use of the developer. By contrast, the carrier adhesion (edge carrier adhesion) is worse at the initial use than after extended use. Therefore, the optimum background potential shifts to a greater value with the use of the developer. In general, in a high-temperature, high-humidity environment, the charge amount of toner is relatively low, thereby worsening the background fogging. By contrast, in a low-temperature, low-humidity environment, the carrier adhesion is worse. In view of the above, according to the present illustrative embodiment, the background potential is optimized or changed to an optimum value with time from the initial state based on the use of the device. Furthermore, in accordance with changes in the environment conditions, the background potential is optimized.

The optimum background potential to achieve the background fogging and the carrier adhesion in a permissible range or equal to or less than a target value is known for each condition through experiments. Therefore, with the information including but not limited to degradation of the charging roller and carrier, and environment information such as changes in the temperature and humidity, it is possible to correct the background potential to some extent. However, due to a difference from the time of the experiment and an unanticipated factor, the optimum background potential may fluctuate. The development start voltage Vk can be considered as a voltage to start development on the photosensitive drum 2. Thus, the background fogging may be worsened without the background potential equal to or greater than the absolute value of the development start voltage Vk.

In view of the above, as illustrated in FIG. 6, after Step S3, the controller 30 determines a target development start voltage Vk' at Step S4. The target development start voltage Vk' is linked to the environment information based on an experiment performed in advance and tabulated. From the initial environment information obtained, the table is referred and the target development start voltage Vk' is determined. Subsequently, at Step S5, the development start voltage Vk is classified by a difference between the development start voltage Vk and the target development start voltage Vk'. For example, the development start voltage Vk is classified as Group 1 when the difference between the development start voltage Vk and the target development start voltage Vk' is equal to or greater than +40 V. The development start voltage Vk is classified as Group 2 when the difference therebetween is equal to or greater than +20 V and less than +40 V. The development start voltage Vk is classified as Group 3 when the difference is equal to or greater than 0 V, and less than +20. The group of the development start voltage Vk is specified, and the amount of correction is determined for each group at Step S6. Subsequently, the correction amount thus obtained at step S5 is added to the background potential calculated from the charge potential Vd and the development bias Vb at step S3, thereby obtaining the target background potential. The charging bias Vc is determined so as to obtain the target background potential at step S7.

The controller 30 performs the above-described process control individually on each color, i.e., yellow, cyan, magenta, and black. That is, values such as the development bias Vb and the charging bias Vc are set individually for each color through the process control.

Figure 9:
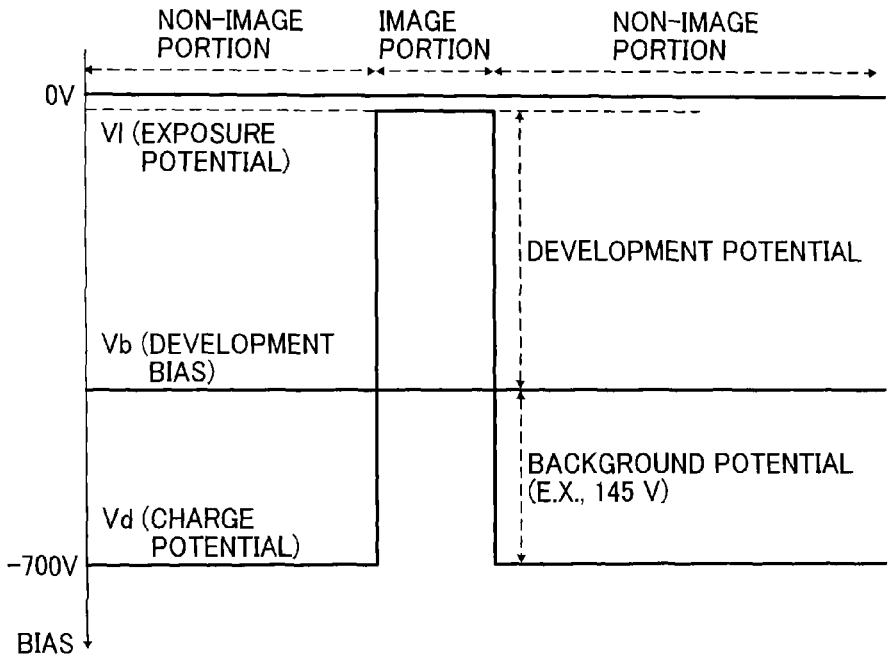
FIG. 9 is a graph showing an example of the development potential and a background potential.

FIG. 9 is a graph for explaining the development potential and the background potential. As illustrated in FIG. 9, the background potential is the difference between the charge potential Vd and the development bias Vb, and acts in the non-image portion (background portion) of the image. The lower is the background potential, the more easily the background fogging occurs. The greater is the background potential, the more easily carrier adhesion occurs. Thus, the background potential needs to be set properly.

Figure 10:
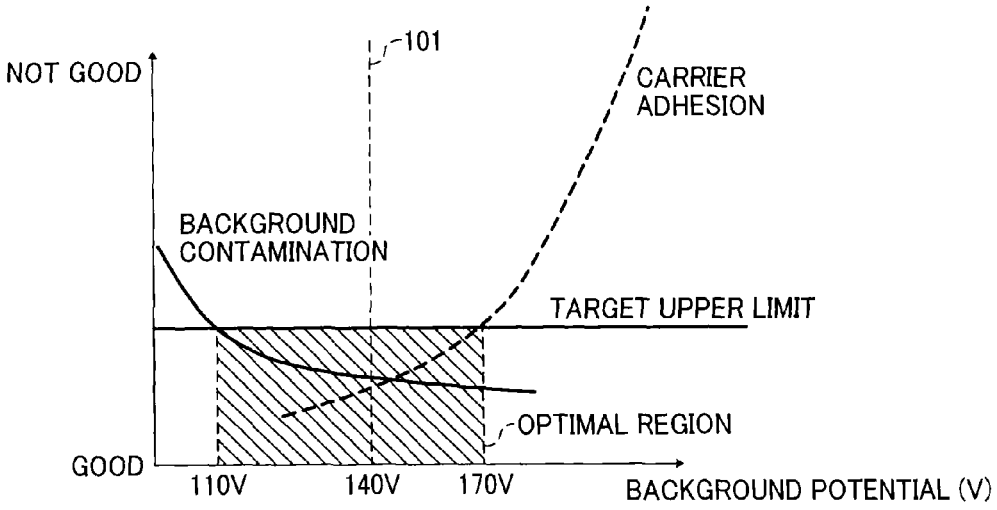
FIG. 10 is a graph showing relations between the background potential, background fogging, and carrier adhesion.

FIG. 10 is a graph showing an example of relations between the background potential, a background fogging, and carrier adhesion. In this example, the theoretical value of the background potential is set to 140 V after the process control. The reason for calling the value as "theoretical" is explained as follows. As described above, the background potential is determined based on the relations between the proper charging voltage Vd and the development bias Vb by the process control. Based on the background potential thus obtained, the charging bias Vc is determined. However, it is not necessarily the case that the charging voltage Vd coincides with the target charging potential due to the charging bias Vc. This is because the discharge start voltage between the charging roller and the photosensitive drum varies between the process units.

In the example shown in FIG. 10, when the background potential is 140 V, both the background fogging and the carrier adhesion are prevented. Therefore, upon process control, the controller 30 determines the target charge potential so as to obtain the background potential of 140 V and a desired development potential. However, because there are unit-to-unit variations in the discharge start voltage between the charging roller and the photosensitive drum between the process units, the charging bias Vc capable of achieving the target charge potential differs between the process units. If the same theoretical value Vs of the discharge start voltage described above is applied to all the process units, there may be a process unit in which the charge potential Vd of the photosensitive drum deviates significantly from the target charge potential, inducing the background fogging and the carrier adhesion.

According to the present illustrative embodiment, as described above, the image forming apparatus employs a contact-type DC charging method in which a charging bias consisting only of the DC component is applied to the charging roller contacting the photosensitive drum. The contact-type DC charging method is cost effective because it does not require an AC power source as compared with a charging method in which an AC-DC superimposed bias is applied as a charging bias. On the one hand, since an alternating electric field is not formed between the charging roller and the photosensitive drum, electrical discharge does not take place between the charging roller and the photosensitive drum unless the charging bias Vc is increased beyond the discharge start voltage. As a result, the photosensitive drum cannot be charged at all.

Figure 11:
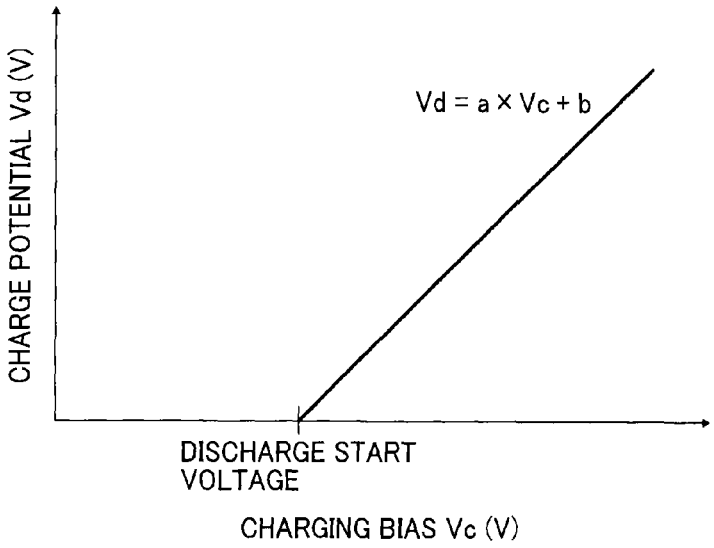
FIG. 11 is a graph showing relations between a charge potential Vd and a charging bias Vc.

Even when the photosensitive drum is charged, the charge potential Vd of the photosensitive member is affected significantly by the discharge start voltage. More specifically, as illustrated in FIG. 11, the charge potential Vd of the photosensitive drum 2Y, for example, has a characteristic expressed by the formula "$Vd=a\times Vc+b$", where "a" represents a slope of the graph, "b" is a Vd axis intercept, and the value thereof is negative. The Vc axis intercept in the graph has similar or the same value as the discharge start voltage between the charging roller and the photosensitive drum. The slope a is similar to or the same as 1. When the discharge start voltage is different, it means that the position in the horizontal axis direction in the graph is different. Thus, the charge potential Vd that can be achieved at the same charging bias Vc increases.

Figure 12:
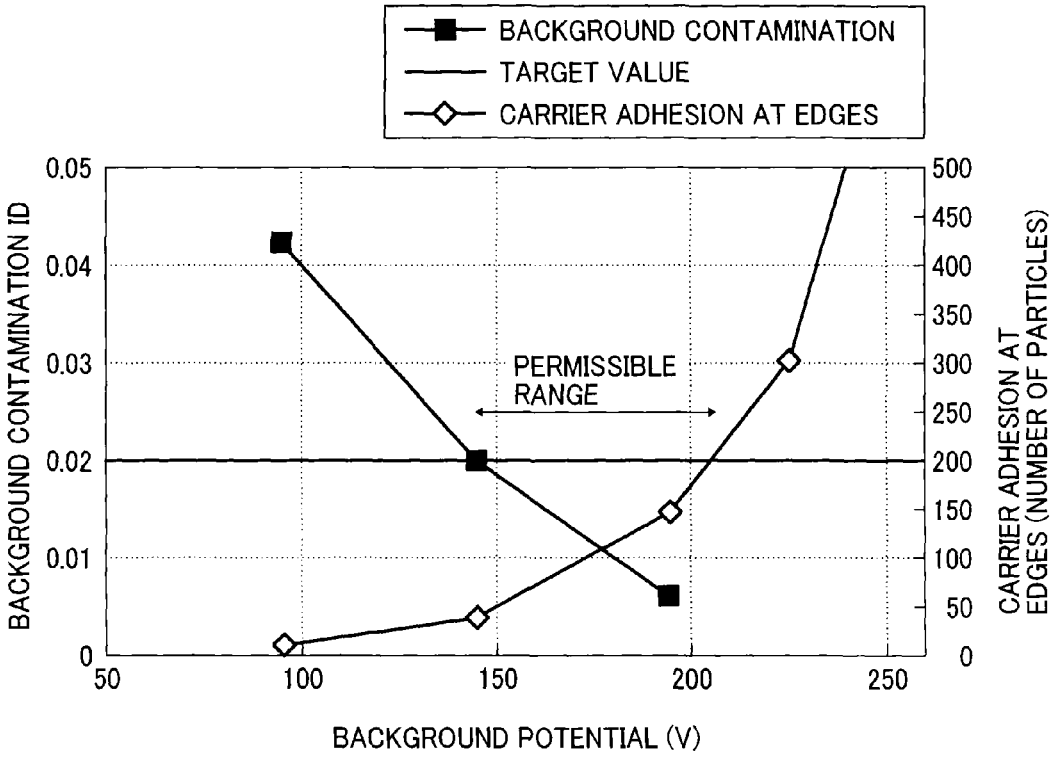
FIG. 12 is a graph showing relations between the background fogging (ID), the background potential, and adhesion of carrier to the photosensitive member (edge-carrier adhesion)

FIG. 12 shows a graph showing relations between the background fogging (ID), the background potential, and the carrier adhesion relative to the photosensitive drum (edge carrier adhesion on the photosensitive drum). The background fogging ID is a measured image density when toner in the non-image formation area of the photosensitive drum is transferred onto an adhesive tape. The edge carrier adhesion refers to a number of magnetic carriers adhered near edges of an image on the photosensitive drum when the image includes many areas in which the edges are emphasized. As illustrated in FIG. 12, when the background potential decreases, the background fogging ID increases. By contrast, when the background potential increases, the edge carrier adhesion increases. In the example shown in FIG. 12, a proper value of the background potential is approximately 180 V. The background fogging and carrier adhesion occur unless the background potential is plus or minus 30 V (±30) from its proper value. The proper value differs according to the model, but the proper value does not fluctuate much if the machine is the same model.

Referring back to FIGS. 5A through 5C, a description is provided of a characteristic configuration of the image forming apparatus according to the illustrative embodiment of the present disclosure.

In FIG. 5, the toner density detectors 4*b*Y, 4*b*C, 4*b*M, and 4*b*K include a memory chip (for example, 4*c*Y for the toner density detector 4*b*Y shown in FIGS. 3 and 4) as a memory circuit to store particular sensitivity information for each detector. In general, a memory chip mounted in a magnetic permeability detector used as a toner density detector has some free space in the storage capacity. Upon shipment from a factory, the memory chip only stores sensitivity information and thus has some free space. Normally, the detector reaches the end of product life without using this free space.

According to the present illustrative embodiment, the free space in the memory chip of the toner density detectors 4*b*Y, 4*b*C, 4*b*M, and 4*b*K stores the travel distance of the photosensitive drums and correction values for the process units 1Y, 1C, 1M, and 1K. As described above, the correction values are for correction of the theoretical value Vs of the discharge start voltage, and are stored in the memory chip upon shipment of the process units 1Y, 1C, 1M, and 1K, as follows. That is, a technician sets a process unit to test in a surface voltmeter for measuring the charge potential Vd. The surface voltmeter applies a predetermined charging bias Vc to the charging roller of the process unit. While charging the photosensitive drum, the charge potential Vd is measured by a surface voltmeter. The technician obtains a correction value Vα using the following formula: $V\alpha=Vc-V\beta-Vd$, where Vα is a correction value, Vc is a charging bias upon measurement, Vβ is a discharge start standard value which is a standard value for the theoretical value Vs of the discharge start voltage, and Vd is the measured charge potential measured by the surface voltmeter.

After obtaining the correction value Vα, the technician stores the information in the memory chip of the toner density detector. Since the travel distance of the photosensitive drum employed in a new process unit is zero, the technician stores "zero" as the travel distance of the photosensitive drum in the memory chip. It is to be noted that the algorithm for the discharge start voltage described above is constructed based on an experiment using a test machine having the discharge start voltage that coincides with the discharge start standard value Vβ.

Figure 13:
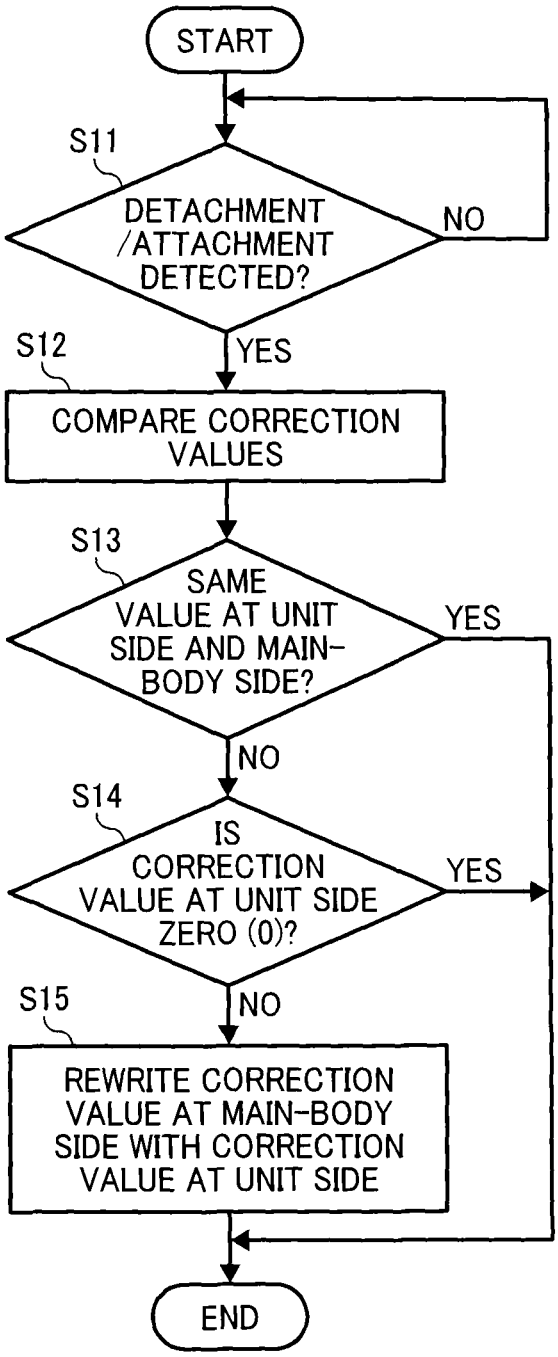
FIG. 13 is a flowchart showing steps of determination of rewrite of a correction value.

FIG. 13 is a flowchart showing steps of determination of rewrite of a correction value. In determination of rewrite of the correction value, when the process units 1Y, 1C, 1M, and 1K are replaced, the correction value Vα for the colors yellow, cyan, magenta, and black stored in the non-volatile memory 30*d* of the controller 30 are rewritten with values that correspond to the process units after replacement. The determination of rewriting the correction value is performed individually for each process unit. For the sake of convenience, a description is provided only of the process unit 1Y for yellow.

At step S11, based on an output from the process unit detector 31Y the controller 30 determines whether or not the process unit 1Y is detached and attached. More specifically, the controller 30 determines whether or not the output from the process unit detector 31Y indicates no process unit and then indicates the presence of the process unit 1Y again. Until the process unit 1Y is detached and attached, the control flow is looped back to step S1 (No, step S11).

If the process unit 1Y is detached and attached (Yes, step S11), the controller 30 reads the correction value Vα stored in the memory chip (i.e., the first storage device or the memory circuit) of the toner density detector 4*b*Y and the correction value Vα stored in the non-volatile memory 30*d* of the controller itself. Subsequently, the controller 30 compares whether the both values coincide with one another. The correction value Vα stored in the memory chip of the toner density detector 4*b*Y is referred to as a unit-side correction value $V\alpha_0$. The correction value Vα stored in the non-volatile memory 30*d* of the controller 30 is referred to as a main-body side correction value $V\alpha_1$.

In a case in which the unit-side correction value $V\alpha_0$ and the main-body side correction value $V\alpha_1$ have the same value, it is highly possible that the process unit 1Y before detachment from the main body of the image forming apparatus and the process unit 1Y that is currently installed in the main body are the same process unit. Even when the process unit 1Y before detachment from the main body of the image forming apparatus and the process unit 1Y that is currently installed in the main body are not the same unit, because both units have the same correction value Vα, it is not necessary to rewrite the main-body side correction value $V\alpha_1$ stored in the non-volatile memory 30*d* of the controller 30. If the unit-side correction value $V\alpha_0$ and the main-body side correction value $V\alpha_1$ have the same value (Yes, S13), the controller 30 determines that rewrite is not necessary and completes the rewrite process. By contrast, when the unit-side correction value $V\alpha_0$ and the main-body side correction value $V\alpha_1$ do not have the same value (No, S13), the controller 30 determines that rewrite is necessary and carries out the process at step S14.

At step S14, the controller 30 determines whether or not the unit-side correction value $V\alpha_0$ is zero. If the unit-side correction value $V\alpha_0$ is not zero (No, step S14), the main-body side correction value $V\alpha_1$ is rewritten with the same value as the unit-side correction value $V\alpha_0$, and the rewrite process is completed. By contrast, if the unit-side correction value $V\alpha_0$ is zero (Yes, step S14), the main-body side correction value $V\alpha_1$ is not rewritten, and the rewrite process is completed. The reason for not rewriting the main-body side correction value $V\alpha_1$ when the unit-side correction value $V\alpha_0$ is not zero is explained later.

It is to be noted that at step S12 the unit-side correction value $V\alpha_0$ and the main-body side correction value $V\alpha_1$ are compared with one another to determine whether the newly installed process unit 1Y is the same process unit as the process unit 1Y installed previously. Thus, as long as the determination can be made, a different value from the correction value may be used as criteria. For example, individual identification information such as an ID number may be stored in the memory chip of the toner density detector 4*b*Y in advance. If the individual identification information on the unit side and the individual identification information on the main body side do not match, the individual identification information on the main body side and the correction value Vα may be rewritten.

In the process control as described above, the theoretical value Vs of the discharge start voltage obtained by using the algorithm for the discharge start voltage is a value common to all the process units, and does not take into account variations in the thickness of the surface of the photosensitive drums and variations in the electrical resistance of the charging rollers. In view of the above, the controller 30 corrects the individually-obtained theoretical value Vs of the discharge start voltage for each of the process units 1Y, 1C, 1M, and 1K based on the main-body side correction value $V\alpha_1$. For example, as for the theoretical value Vs of the discharge start voltage for the process unit 1Y, the main-body side correction value $V\alpha_1$ for yellow stored in the non-volatile memory 30*d* is read, and the result is added to correct the theoretical value Vs of the discharge start voltage. Subsequently, the target charge potential is added to the corrected theoretical value Vs of the discharge start voltage, thereby obtaining the target value of the charging bias Vc.

According to the present illustrative embodiment, the theoretical value Vs of the discharge start voltage before correction, which is used as the value common to all the process units, is corrected based on the main-body side correction value $V\alpha_1$ in accordance with individual variations for each process unit and is used to calculate the charging bias Vc. With this configuration, the deviation of the charge potential Vd from the target charge potential due to unit-to-unit variations of the discharge start voltage is reduced, thereby preventing the background fogging and carrier adhesion attributed to the unit-to-unit variations.

Alternatively, instead of using the correction value $V\alpha$, the measured charge potential Vd of the photosensitive drum measured by the surface voltmeter described above, the measured discharge start voltage, and so forth may be stored as a characteristic value in the memory chip. If the measured charge potential Vd when using the predetermined charging bias Vc is known, the correction value $V\alpha$ can be obtained by the above-described formula "$V\alpha=Vc-V\beta-Vd$". Likewise, if the measured discharge start voltage and the discharge start standard value $V\beta$ are known, the correction value $V\alpha$ can be obtained.

According to the present illustrative embodiment, in the image forming apparatus the actual correction value is not used as the unit-side correction value $V\alpha_0$ in the calculation as is. The sum of the actual correction value and a predetermined constant is stored in the memory chip of the toner density detector. For example, assuming that the actual correction value is in a range from −50 V to +50 V, and the storage area of the memory chip allows an input number from 0 to 128, the midpoint value from 0 to 128, that is, 64, is used as the predetermined constant. 64 is added to the actual correction value, and the sum of the actual correction value and the constant 64 is stored as the unit-side correction value $V\alpha_0$ in the memory chip. That is, values in a range from 14 to 114 are stored as the unit-side correction value $V\alpha_0$ in the memory chip.

As described above, the sum of the actual correction value and the predetermined constant is stored as the unit-side correction value $V\alpha_0$ in the memory chip for the following reason. That is, with regards to the theoretical value Vs of the discharge start voltage, there is a case in which the theoretical value Vs of the discharge start voltage is shifted to a negative side, and also there is a case in which the theoretical value Vs of the discharge start voltage is shifted to a positive side. In the present illustrative embodiment, the theoretical value Vs of the discharge start voltage is corrected by adding the correction value $V\alpha$ (more precisely, $V\alpha_1$). Consequently, in a case in which the theoretical value Vs of the discharge start voltage is shifted to the negative side, for example, it is necessary to add −30 V as the correction value $V\alpha$ to the correction amount of 30 V. When storing the value in the memory chip, it is necessary to store information as to whether the correction amount is on the positive side or the negative side in addition to the correction amount, causing the time and effort of the technicians.

In view of the above, according to the present illustrative embodiment, the sum of the actual correction value and the predetermined constant (for example, 64) is stored as the unit-side correction value $V\alpha_0$ in the memory chip, instead of storing the actual correction value. With this configuration, regardless of the actual correction value being positive or negative, the unit-side correction value $V\alpha_0$ can be unified as a positive value. Thus, an effort to store information as to whether the actual correction value is a positive or a negative value is not necessary, thereby reducing the time and effort of technicians at a factory and manufacturing cost. The predetermined constant is configured such that even when a maximum value on the negative side within a range to be used as an actual correction value is added, the sum is equal to or greater than one (1). Therefore, normally, zero (0) is not stored as the unit-side correction value $V\alpha_0$.

According to the present illustrative embodiment, upon shipment of a new process unit including a combination of a new photosensitive drum unit and a new development unit, a value other than zero (0) is always stored as the unit-side correction value $V\alpha_0$ in the memory chip.

Generally, a replacement part for the process units 1Y, 1C, 1M, and 1K to be supplied to users is only a new process unit including a combination of a new development unit and a new photosensitive drum unit. The new development unit and the new photosensitive drum unit are not to be individually distributed to the users. When the new development unit and the new photosensitive drum unit are assembled as a single integrated unit as a process unit, replacement operation is relatively easy and hence the users can replace the process unit. By contrast, replacement operation of only the development unit or the photosensitive drum unit is relatively difficult for the users. It is generally the case that when replacing only the development unit or the photosensitive drum unit a trained technician is sent to the users and replaces.

TABLE 1 shows relations between a condition of the process unit installed in the image forming apparatus and rewrite of the main-body side correction value $V\alpha_1$ by the controller 30.

TABLE 1

| CASE NO. | PHOTOSENSITIVE DRUM UNIT | DEVELOPMENT UNIT | APPLICATION OF $V\alpha_0$ | $V\alpha_0$ | REWRITE OF $V\alpha_1$ BY CONTROLLER |
|---|---|---|---|---|---|
| 1 | REPLACED AS PROCESS UNIT | | YES | OTHER THAN 0 | YES |
| 2 | REPLACED INDIVIDUALLY | SAME UNIT AS THAT BEFORE DETACHMENT/ ATTACHMENT | NO | OTHER THAN 0 | NO |
| 3 | SAME UNIT AS THAT BEFORE DETACHMENT/ ATTACHMENT | REPLACED INDIVIDUALLY | NO | 0 | NO |
| 4 | SAME PROCESS UNIT AS THAT BEFORE DETACHMENT/ATTACHMENT | | YES | OTHER THAN 0 | NO |

In TABLE 1, Case No. 1 is an example in which the process unit is replaced per unit. Replacement herein refers to installation of a different unit from the previously installed unit, and the different unit may be a new or a recycled unit. Regardless of the installed process unit being a new one or a recycled one, the unit-side correction value $V\alpha_0$ does not coincide with the main-body side correction value $V\alpha_1$, except for when the new and the old correction values $V\alpha$ accidentally coincide with each other. In this case, when it is left as it is, the main-body side correction value $V\alpha_1$ different from the unit-side correction value $V\alpha_0$ of the process unit being installed actually is used.

By contrast, according to the present illustrative embodiment, in Case No. 1, after it is determined that the main-body side correction value $V\alpha_1$ and the unit-side correction value $V\alpha_0$ do not coincide at step S13 in FIG. 13 (NO, step S13), the process advances to step S14 (NO, step S14, which will be described later), and then advances to the process at step S15. At step S15, the main-body side correction value $V\alpha_1$ is rewritten with the same value as the unit-side correction value $V\alpha_0$. With this configuration, in a case in which the process unit is replaced per unit, in both the new and the recycled units, the main-body side correction value $V\alpha_1$ is rewritten with a proper value corresponding to the process unit after replacement.

At step S14, it is determined "NO" for the following reason. That is, as described above, in a case in which the process unit consisting of the combination of the photosensitive drum unit and the development unit is shipped, a value other than zero (0) is always stored as the unit-side correction value $V\alpha_0$ in the memory chip.

In TABLE 1, Case No. 2 is an example in which only the photosensitive drum unit is replaced and the same development unit as that before detachment is installed. The discharge start voltage is a characteristic value of the photosensitive drum unit, and the unit-side correction value $V\alpha_0$ corresponding thereto is stored in the memory chip of the toner density detector of the development unit. In Case No. 2, the unit-side correction value $V\alpha_0$ stored in the memory chip corresponds to the photosensitive drum unit before replacement. Therefore, the value is inappropriate for the current photosensitive drum unit. However, the controller 30 cannot recognize this, and instead, recognizes that the unit-side correction value $V\alpha_0$ after detachment/attachment and the main-body side correction value $V\alpha_1$ coincide with each other (YES, step S13 in FIG. 13). As a result, the entire process unit is recognized as the same process unit as that before detachment/attachment, and hence the controller 30 finishes the determination process for rewriting the correction value without rewriting.

In view of the above, according to the present illustrative embodiment, the photosensitive drum unit to be shipped alone from the factory to maintenance personnel is provided with a bar code representing a coded unit-side correction value $V\alpha_0$ and a coded sign such as a QR code (registered trademark) printed on a sticker attached to a casing of the photosensitive drum unit. Furthermore, the image forming apparatus includes an input device for an operator to input the data for rewriting the main-body side correction value $V\alpha_1$ stored in the non-volatile memory 30*d* as the second memory. A control display unit 85, an I/O connector 86, the controller 30, and so forth shown in FIG. 5 constitute the input device. The control display unit 85 includes a numerical keypad and a touch screen, and is capable of sending information input by the operator to the controller 30. The I/O connector 86 can be connected to an optical reader such as a bar-code reader capable of optically reading bar codes.

In Case No. 2, only the photosensitive drum unit is replaced by separating the process unit, which means that the photosensitive drum unit is replaced by a technician. Prior to installation of the process unit to which the new photosensitive drum unit is attached, the technician inputs a particular code number designated for the technician to the control display unit 85 of the main body of the image forming apparatus. Subsequently, the controller 30 shows on the control display unit 85 a special maintenance menu screen, which is not provided to general users. The technician selects a mode for rewriting the correction value from the maintenance menu screen. Subsequently, the controller 30 shows a message on the control display unit 85 that reads "After connecting the optical reader to the connector, please scan the code for the new photosensitive drum unit". In accordance with the message, the technician scans the code printed on the sticker using the optical reader. As a result, the data of a new unit-side correction value $V\alpha_0$ as a scan result is sent to the controller 30. The controller 30 rewrites the main-body side correction value $V\alpha_1$ stored in the non-volatile memory 30*d* with the same value as the unit-side correction value $V\alpha_0$ being sent.

With this configuration, even when only the photosensitive drum unit is replaced, the main-body side correction value $V\alpha_1$ is rewritten with a proper value corresponding to the photosensitive drum unit after replacement by the manual operation of the technician.

In TABLE 1, Case No. 3 is an example in which only the development unit is replaced, and the same photosensitive drum unit as that before detachment/attachment is installed. In this case, because the photosensitive drum and the charging roller are not replaced, the main-body side correction value $V\alpha_1$ stored in the non-volatile memory 30*d* of the controller 30 needs to be used continuously. However, because the development unit which mounts the memory chip is replaced, there is a possibility that the main-body side correction value $V\alpha_1$ is rewritten with the same value as the unit-side correction value $V\alpha_0$ stored in the memory chip.

In view of the above, according to the present illustrative embodiment, a value of zero (0) is stored as the unit-side correction value $V\alpha_0$ in the memory chip of the toner density detector of the development unit to be shipped alone from the factory to maintenance personnel. Furthermore, in the determination of rewriting a correction value in FIG. 13, the process at step S14 is carried out.

When using the unit-side correction value $V\alpha_0$ as a target correction value as intended, as described above, the unit-side correction value $V\alpha_0$ is never zero (0). In a case in which no correction is needed, the constant will be "0+Constant=Constant". Thus, the unit-side correction value $V\alpha_0$ has the same value as the predetermined constant. In other cases, the unit-side correction value $V\alpha_0$ is equal to or greater than one (1). When the unit-side correction value $V\alpha_0$ is zero, this means a special case which is normally impossible. In the present illustrative embodiment, this means that the development unit installed in the image forming apparatus was the one shipped alone from the factory to be provided to the maintenance personnel.

In FIG. 13, if YES at step S13, it is necessary to rewrite the unit-side correction value $V\alpha_0$. Subsequently, however, if YES at step S14, it means that the development unit is a special unit shipped alone from the factory. In this case, as shown in FIG. 13, the determination of rewriting a correction value is finished without rewriting, thereby preventing the main-body side correction value $V\alpha_1$ from getting rewritten with an improper value for the photosensitive drum unit installed actually in the image forming apparatus.

The image forming apparatus may include the following configurations in addition to the above-described configurations.

EXAMPLE 1

The product life cycle of the development device, for example, the development device 4Y, depends on degradation and malfunction of parts, and also on degradation of magnetic carrier. In either case, when a cumulative operating time reaches a certain time, it is highly possible that the product life cycle reaches the end, and thus determination as to whether the product life cycle reaches the end is made based on the number of prints and the travel distance of the roller. In addition, when the degree of degradation of the magnetic carrier is taken into consideration in prediction of the end of the product life cycle, the time at which the product life cycle reaches the end can be predicted more precisely.

Thus, it is desirable to use the degree of degradation of the magnetic carrier as one of criteria for determination of the product life cycle. Electrical resistance of the magnetic carrier drops as degradation of the magnetic carrier progresses. A lower limit of the electrical resistance that can be used as the magnetic carrier to be set in the development unit is predetermined by design. Therefore, when the electrical resistance of the magnetic carrier drops to the lower limit, this means that the development unit has reached the end of the product life cycle.

Whether or not the electrical resistance of the magnetic carrier has dropped to the lower limit can be predicted based on the number of prints and the travel distance of the roller with a relatively high accuracy. However, if the initial value of the electrical resistance is different, the number of prints and the travel distance of the roller from the beginning of use to the end of the product life cycle are also different. Thus, it is desirable that the initial value of the electrical resistance be taken into consideration. However, the initial value varies for every carrier product.

In view of the above, the initial value (measured value) of the electrical resistance of the magnetic carrier in the development unit is stored in the memory chip of the toner density detector of the development unit in advance. Upon installation of the process unit in the main body of the image forming apparatus, the information on the initial value together with the unit-side correction value $V\alpha_0$ is read by the controller 30 and stored in the non-volatile memory 30*d*. The controller 30 calculates threshold values for the number of prints and the travel distance of the roller based on the initial value of the electrical resistance of the magnetic carrier and a predetermined algorithm for calculating a product life cycle. The time at which the number of prints and the travel distance of the roller reach the threshold values is considered as the end of the product life cycle.

EXAMPLE 2

Relatively low electrical resistance of the magnetic carrier causes easily carrier adhesion in which the magnetic carrier on the development member moves to the surface of the photosensitive member undesirably. The greater is the development potential which is a difference between the potential of the electrostatic latent image on the photosensitive member and the development bias, the more easily carrier adhesion occurs.

In view of the above, in the process control, it is desirable that based on a predicted value of the electrical resistance of the magnetic carrier the upper limit value of the development potential be determined, and the development bias Vb and the charge potential Vd be determined based on the upper limit value thus obtained. However, the initial value of the electrical resistance of the magnetic carrier varies for every carrier product. Thus, it is difficult to predict accurately the electrical resistance of the magnetic carrier.

In view of the above, the initial value (measured value) of the electrical resistance of the magnetic carrier in the development unit is stored in the memory chip of the toner density detector of the development unit in advance. Upon installation of the process unit in the main body of the image forming apparatus, the information on the initial value together with the unit-side correction value $V\alpha_0$ is read by the controller 30 and stored in the non-volatile memory 30*d*. The controller 30 calculates a predicted value of the electrical resistance of the magnetic carrier based on the initial value of the electrical resistance of the magnetic carrier, the number of prints or the travel distance of the roller, and a predetermined algorithm for predicting the electrical resistance. In the process control, based on the predicted value of the electrical resistance of the magnetic carrier, the upper limit value of the development potential is calculated, and the development bias Vb and the charge potential Vd are determined based on the upper limit value thus obtained.

EXAMPLE 3

When a ratio of weakly charged toner and oppositely charged toner with opposite polarity to the normal polarity is relatively large, toner spatters and contaminates easily inside the device, and/or spatters easily from an image portion to the background portion hence contaminating the background portion. The ratio of the weakly charged toner and the oppositely charged toner depends on the toner charge ability of the magnetic carrier.

As the toner density of the developer or the development agent is increased, the ratio of the weakly charged toner and the oppositely charged toner increases, causing toner to spatter easily, which results in contamination. Thus, it is desirable that the upper limit value of the toner density in the developer be within a range in which toner spatter and contamination with spattered toner do not occur. In order to achieve such an effect, it is necessary to predict the toner charge ability of the magnetic carrier accurately. However, the toner charge ability varies for every carrier product. Thus, it is difficult to predict accurately the toner charge ability.

In view of the above, the toner charge ability (measured value) of the magnetic carrier in the development unit is stored in the memory chip of the toner density detector of the development unit in advance. Upon installation of the process unit in the main body of the image forming apparatus, the information on the toner charge ability together with the unit-side correction value $V\alpha_0$ is read by the controller 30 and stored in the non-volatile memory 30*d*. The controller 30 calculates the upper limit value of the toner density of the developer based on the toner charge ability of the magnetic carrier and a predetermined algorithm for calculating the upper limit value. Subsequently, based on the upper limit value of the toner density of the developer thus obtained, the control target value of the toner density of the developer is determined.

EXAMPLE 4

As described above, the greater is the background potential, the more easily carrier adhesion occurs. Generation of the carrier adhesion is influenced not only by the background potential, but also the toner charge ability of the magnetic carrier. As the toner charge ability of the magnetic carrier becomes higher, the magnetic carrier particles accumulate counter charges having a polarity opposite that of the toner, thereby causing carrier adhesion more easily. By contrast, as the background potential becomes less, the background fogging occurs easily. Generation of the background fogging is influenced not only by the background potential, but also the toner charge ability of the magnetic carrier.

As the toner charge ability of the magnetic carrier becomes less, the ratio of the weakly charged toner and the oppositely charged toner increases, causing the background fogging. In view of the above, it is desirable to set the range of the background potential from the minimum to the maximum in accordance with the toner charge ability of the magnetic carrier, and to determine in the process control the background potential within that range. Thus, it is necessary to predict the toner charge ability of the magnetic carrier accurately. However, the toner charge ability varies for every carrier product. Thus, it is difficult to predict accurately the toner charge ability.

In view of the above, the toner charge ability (measured value) of the magnetic carrier in the development unit is stored in the memory chip of the toner density detector of the development unit in advance. Upon installation of the process unit in the main body of the image forming apparatus, the information on the toner charge ability together with the unit-side correction value $V\alpha_0$ is read by the controller 30 and stored in the non-volatile memory 30*d*. The controller 30 calculates the range of the background potential from the minimum to the maxim based on the toner charge ability of the magnetic carrier and the predetermined algorithm for calculating the range. In the process control, the background potential is determined within that range.

EXAMPLE 5

Due to an edge electrical field formed at the boundary of the latent image and the non-image portion around the latent image on the photosensitive drum, carrier adhesion occurs at the edge portion. Occurrence of carrier adhesion depends on the toner charge ability of the magnetic carrier. As the toner charge ability of the magnetic carrier becomes higher, the magnetic carrier particles accumulate counter charges having a polarity opposite that of the toner, thereby causing carrier adhesion more easily. Also, the greater is the background potential, the more easily carrier adhesion occurs.

In view of the above, in accordance with the toner charge ability of the magnetic carrier, the upper limit value of the development bias, which is the maximum permissible value at which the carrier adhesion does not occur, is determined. It is desirable that in the process control the development bias be determined below the upper limit value. Thus, it is necessary to predict the toner charge ability of the magnetic carrier accurately. However, the toner charge ability varies for every carrier product. Thus, it is difficult to predict accurately the toner charge ability.

In view of the above, the toner charge ability (measured value) of the magnetic carrier in the development unit is stored in the memory chip of the toner density detector of the development unit in advance. Upon installation of the process unit in the main body of the image forming apparatus, the information on the toner charge ability together with the unit-side correction value $V\alpha_0$ is read by the controller 30 and stored in the non-volatile memory 30*d*. The controller 30 calculates the upper limit value of the development potential based on the toner charge ability of the magnetic carrier and the predetermined algorithm for calculating the upper limit. In the process control, the background potential is determined below the upper limit value.

EXAMPLE 6

In a case in which a bulk density of the developer is relatively low, the desired amount of the developer cannot be carried on the development roller of the development device, causing imaging failure or producing an image defect. By contrast, in a case in which the bulk density of the developer is relatively high, the developer spills in the development device, and the developer accumulates between the development roller and the photosensitive drum, causing imaging failure or producing an image defect as well.

The bulk density of the developer changes depending on the toner density of the developer. As the toner density decreases, the bulk density decreases. As the toner density increases, the bulk density increases. Therefore, in order to prevent imaging failure or an image defect due to deficiency and excess of bulk density, it is desirable that the control target value of the toner density be in a range from the upper limit at which the developer has the bulk density (low density side) at which the developer does not spill to the lower limit at which the developer has the bulk density at which no image defect is produced. However, the upper limit value of the toner density at which the developer has the bulk density at which the developer does not spill and the lower limit value of the toner density at which the developer has the bulk density (low density) at which no image defect is produced vary for every carrier product.

In view of the above, the information on the lower and the upper values of the toner density corresponding to the magnetic carrier in the development unit is stored in the memory chip of the toner density detector of the development unit in advance. Upon installation of the process unit in the main body of the image forming apparatus, the information on the lower limit value and the upper limit value as well as the unit-side correction value $V\alpha_0$ is read by the controller 30 and stored in the non-volatile memory 30*d*. The controller 30 determines the control target value of the toner density within the range from the lower limit value to the upper limit value.

EXAMPLE 7

The surface layer of the photosensitive drum is subjected to abrasion over time, and thickness thereof becomes thinner gradually. The lower limit value of the thickness of the surface layer of the photosensitive drum employed in the image forming apparatus is determined during the design stage. The time at which the thickness of the surface layer reaches the lower limit is considered as the end of the product life cycle. Thus, it is desirable that the time at which the photosensitive member reaches the end of its product life cycle be determined by predicting the thickness of the surface layer of the photosensitive drum based on the number of prints and the travel distance of the photosensitive drum. In order to do so, it is necessary to predict accurately the thickness of the surface layer. However, the initial value of the surface layer of the photosensitive drum varies between the photosensitive drum units. Thus, it is difficult to predict accurately the thickness of the surface layer of the photosensitive drum.

In view of the above, the initial value (measured value) of the thickness of the surface layer of the photosensitive drum is stored in the memory chip of the toner density detector of the development unit in advance. Upon installation of the process unit in the main body of the image forming apparatus, the information on the initial value together with the unit-side correction value $V\alpha_0$ is read by the controller 30 and stored in the non-volatile memory 30*d*. The controller 30 calculates a predicted thickness of the surface layer of the photosensitive drum based on the initial thickness of the surface layer of the photosensitive drum, the number of prints or the travel distance of the photosensitive drum, and a predetermined algorithm for calculating the thickness. Based on the result, the time at which the photosensitive drum reaches the end of the product life cycle is predicted.

EXAMPLE 8

While the surface of the photosensitive drum moves in accordance with rotation of the photosensitive drum, the trace of the electrostatic latent image and non-image portion from the previous imaging cycle may appear as a residual image in the subsequent imaging cycle. The thicker is the surface layer of the photosensitive drum, the more easily the residual image is generated. Also, as the background potential becomes less, the residual image is generated easily.

In view of the above, it is desirable to determine in the process control the lower limit value of the background potential in accordance with the thickness of the surface layer of the photosensitive drum, and to set the background potential on or above the lower limit value. In order to do so, it is necessary to predict accurately the thickness of the surface layer. However, the initial value of the surface layer of the photosensitive drum varies between the photosensitive drum units. Thus, it is difficult to predict accurately the thickness of the surface layer of the photosensitive drum.

In view of the above, the toner charge ability (measured value) of the magnetic carrier in the development unit is stored in the memory chip of the toner density detector of the development unit in advance. Upon installation of the process unit in the main body of the image forming apparatus, the information on the initial value together with the unit-side correction value $V\alpha_0$ is read by the controller 30 and stored in the non-volatile memory 30*d*. The controller 30 predicts the thickness of the surface layer of the photosensitive drum based on the initial value of the thickness of the surface layer of the photosensitive drum, the number of prints or the travel distance of the photosensitive drum, and the predetermined algorithm for calculating the thickness. Based on the result, the lower limit value of the background potential is determined, and the background potential is set to be on or above the lower limit value.

EXAMPLE 9

The potential of the electrostatic latent image of the photosensitive drum changes depending on the light intensity of a writing light beam from the optical writing unit. When the thickness of the surface layer of the photosensitive drum is different, the potential of the electrostatic latent image changes under the same light intensity of the writing light beam. In order to obtain the potential of the electrostatic latent image at a constant level, as the thickness of the surface layer of the photosensitive drum is thicker, the light intensity of the writing light beam needs to be reduced. That is, it is desirable that the light intensity of the writing light be set in accordance with the thickness of the surface layer of the photosensitive drum. In order to do so, it is necessary to predict accurately the thickness of the surface layer. However, the initial value of the surface layer of the photosensitive drum varies between the photosensitive drum units. Thus, it is difficult to predict accurately the thickness of the surface layer.

In view of the above, the initial thickness (measured value) of the surface layer of the photosensitive drum is stored in the memory chip of the toner density detector of the development unit in advance. Upon installation of the process unit in the main body of the image forming apparatus, the information on the initial value together with the unit-side correction value $V\alpha_0$ is read by the controller 30 and stored in the non-volatile memory 30*d*. The controller 30 predicts the thickness of the surface layer of the photosensitive drum based on the initial value of the thickness of the surface layer of the photosensitive drum, the number of prints or the travel distance of the photosensitive drum, and the predetermined algorithm for calculating the thickness. In the process control, the light intensity of the writing light is determined.

EXAMPLE 10

When the development gap which is a gap between the development roller of the development device and the photosensitive drum changes, the development ability changes accordingly. The greater is the development gap, the less is the development ability, hence reducing the image density. By contrast, the smaller is the development gap, the greater is the development ability, thereby increasing the image density. The development ability also changes due to environment conditions. For example, in a low-temperature, low-humidity environment, the charge amount of toner increases and the development ability is reduced accordingly. By contrast, in a high-temperature, high-humidity environment, the charge amount of toner decreases and the development ability increases accordingly.

The development ability can be controlled by the toner density. In a low-temperature, low-humidity environment, even when the toner density is increased to the upper limit level, the development ability is insufficient in a device with a relatively large development gap, possibly causing insufficient image density. By contrast, in a high-temperature, high-humidity environment, even when the toner density is reduced to the lower limit level, the development ability is excessive in a device with a relatively small development gap, possibly causing excessive image density. Thus, it is desirable that the upper limit value and the lower limit value of the toner density be set in accordance with the development gap. In order to do so, it is necessary to predict accurately the development gap. However, the development gap varies between the development units.

In view of the above, information on the development gap (measured value) is stored in the memory chip of the toner density detector of the development unit in advance. Upon installation of the process unit in the main body of the image forming apparatus, the information on the development gap together with the unit-side correction value $V\alpha_0$ is read by the controller 30 and stored in the non-volatile memory 30*d*. The controller 30 calculates the upper limit value and the lower limit value of the toner density based on the development gap and the predetermined algorithm for calculating the upper and the lower limit values. In the process control, the controller 30 determines the control target value of the toner density within the range from the lower limit value to the upper limit value.

Although the embodiments of the present disclosure have been described above, the present invention is not limited to the foregoing embodiments, but a variety of modifications can be made within the scope of the present invention.

[Aspect A]

According to an aspect of this disclosure, an image forming apparatus includes a process unit (for example, the process unit 1Y) detachably attachable relative to a main body of the image forming apparatus, the process unit including as a single integrated unit a latent image bearing member (for example, the photosensitive drum 2Y) to bear a latent image on a surface thereof, a charging device (for example, the charging device including the charging roller 3Y) to charge the surface of the latent image bearing member, and a development device (for example, the development device 4Y) to develop the latent image on the surface of the latent image bearing member with toner to form a toner image, a latent image writer (for example, the optical writing unit 6) to write the latent image on the surface of the latent image bearing member charged by the charging device; a power source (for example, the power source 50Y) to output a charging bias supplied to the charging device; and a controller (for example, the controller 30) operatively connected to the power source to cause the power source to output the charging bias at a predetermined target level. The process unit further includes a first storage device (for example, the memory chip 4*c*Y of the toner density detector 4*b*Y) to store correction information (for example, unit-side correction value $V\alpha_0$) for calculating the target level of the charging bias in accordance with a combination of the latent image bearing member and the charging device. The controller corrects the target level based on the correction information stored in the first storage device.

In the present configuration, based on the correction information stored in the storage device, the target value of the charging bias is adjusted to a value corresponding to the discharge start voltage of the process unit mounted in the image forming apparatus. With this configuration, the background fogging and carrier adhesion caused by variations of the discharge start voltage between the process units can be reduced, if not prevented entirely.

It is to be noted that the correction information includes, but is not limited to the unit-side correction value $V\alpha_0$, the measured value of the charge potential Vd as a characteristic value, and the measured value of the discharge start voltage as a characteristic value. In a case in which the unit-side correction value $V\alpha_0$ is stored in the storage device, the controller corrects the target value of the charging bias using the unit-side correction value $V\alpha_0$ as a correction value. In a case in which the measured value of the charge potential Vd is stored in the storage device, the controller obtains the measured value of the discharge start voltage based on the measured value of the charge potential Vd, obtains the correction value based on the calculation result and the standard value of the discharge start voltage, and corrects the target value of the charging bias based on the calculation result. In a case in which the measured value of the discharge start voltage is stored in the storage device, the controller obtains the correction value based on the measured value and the standard value of the discharge start voltage and corrects the target value of the charging bias based on the calculation result.

[Aspect B]

The image forming apparatus according to Aspect A further includes a process unit detector (for example, the process unit detector 31Y) to detect detachment and attachment of the process unit relative to the main body of the image forming apparatus. The controller includes a second storage device (for example, the non-volatile memory 30*d*), and based on detection of detachment and attachment of the process unit by the process unit detector the controller reads the correction information from the first storage device (for example, the memory chip 4*c*Y) and stores in the second storage device one of the correction information read from the first storage device and a predetermined calculation result based on the correction information to correct the target level of the charging bias.

In the present configuration, based on the correction information stored in the second storage device of the controller or the predetermined calculation result based on the correction information, the target value of the charging bias is obtained. This configuration enhances the reading speed and reduces consumption of energy upon reading as compared with a configuration in which the correction information stored in the first storage device of the process unit is read and used to correct the target value. This results in an increase in the calculation speed of the target value while reducing energy.

[Aspect C]

In the image forming apparatus according to Aspect B, in addition to the correction value or the characteristic value, the first storage device stores individual identification information (for example, the ID number) of the process unit, and based on the detection of detachment and attachment of the process unit by the process unit detector the controller reads the individual identification information from the first storage device and stores the individual identification information in the second storage device.

With this configuration, after detection of detachment and attachment of the process unit, whether or not the currently installed process unit is the same process unit as the one before detachment/attachment can be identified. That is, whether or not the individual identification information stored in the first storage device of the process unit side corresponds to the individual identification information stored in the second storage device of the main body side is determined.

[Aspect D]

In the image forming apparatus according to Aspect B or Aspect C, upon detection of detachment and attachment of the process unit by the process unit detector, based on the correction information stored in the first storage device and one of the correction information and the predetermined calculation result stored in the second storage device the controller determines whether or not to rewrite one of the correction information and the predetermined calculation result stored in the second storage device with a value corresponding to the correction information stored in the first storage device.

In the present configuration, based on the correction information stored in the first storage device, and one of the correction information and the calculation result stored in the second storage device, whether or not the process unit currently installed in the image forming apparatus is a replaced process unit is determined. Only in a case in which it is determined that the process unit is a replaced process unit, one of the correction information and the calculation result stored in the second storage device is rewritten, thereby preventing unnecessary writing and hence extending the product life of the second storage device, and saving energy.

[Aspect E]

In the image forming apparatus according to Aspect D, the process unit separably includes an image bearer unit such as the photosensitive drum unit including the latent image bearing member and the charging device, and a development unit including the development device and a toner density detector (for example, the toner density detector 4*b*Y) including a memory circuit (for example, the memory chip 4*c*Y) as the first storage device to detect a toner density of a development agent in the development device.

With this configuration, no additional storage device for storing the correction information is needed, thereby reducing the cost of the process unit.

[Aspect F]

In the image forming apparatus according to Aspect E, in a case in which (for example, YES at step S14 in FIG. 13) the correction information stored in the memory circuit includes a predetermined value (for example, zero), the controller determines not to rewrite regardless of a result in which it is determined to rewrite based on the correction information stored in the memory circuit and one of the correction information and the predetermined calculation result stored in the second storage device (for example, NO at step S3 in FIG. 13).

With this configuration, as described above with reference to Case No. 3 of TABLE 1 as an example, in a case in which only the development unit is replaced, the correction information or the calculation result stored in the second storage device is prevented from getting rewritten with an improper value.

[Aspect G]

The image forming apparatus according to Aspect F further includes an input device operated by a user to input data for rewriting one of the correction information and the predetermined calculation result stored in the second storage device.

With this configuration, as described above with reference to Case No. 2 of TABLE 1 as an example, in a case in which only the image bearer unit is replaced, the correction information or the calculation result stored in the second storage device can be rewritten with a proper value corresponding to the image bearer unit by a manual operation by the user.

[Aspect H]

In the image forming apparatus according to Aspect G, the image bearer unit includes a casing, and one of the correction information and the predetermined calculation result is coded and attached visibly to the casing.

With this configuration, a technician does not have to manually input the correction information or the calculation result to the second storage device, but the code reader inputs mechanically, hence facilitating maintenance and preventing incorrect input.

[Aspect I]

In the image forming apparatus according to any one of Aspects F through H, the memory circuit stores a sum of a regular correction value and a predetermined constant (for example, 64), and the second storage device stores the correction information read from the memory circuit and converted to the regular correction value by substituting the predetermined constant.

With this configuration, as described above, an effort to store information as to whether the correction value is a positive or a negative value in the first storage device is not necessary, thereby reducing the manufacturing cost, and the time and effort of technicians at a factory.

[Aspect J]

An image forming apparatus includes: a process unit detachably attachable relative to a main body of the image forming apparatus, the process unit separably including as a single integrated unit, an image bearer unit including a latent image bearing member to bear a latent image on a surface thereof and a charging device to charge the surface of the latent image bearing member, and a development unit including a development device to develop the latent image on the surface of the latent image bearing member with toner to form a toner image and a toner density detector to detect a toner density of a development agent in the development device, the toner density detector including a memory circuit to store correction information for correcting a target charging bias in accordance with the process unit, a latent image writer to write the latent image on the surface of the latent image bearing member charged by the charging device; a power source to output a charging bias supplied to the charging device; and a controller operatively connected to a predetermined device associated with a predetermined control parameter based on a target value of the predetermined control parameter. In a case in which the process unit is detached from and attached to the main body of the image forming apparatus, the controller determines whether or not to rewrite one of the correction information and the predetermined calculation result stored in a storage device of the main body of the image forming apparatus with a value stored in the memory circuit of the toner density detector based on the correction information stored in the memory circuit and one of the correction information and a predetermined calculation result based on the correction information stored in a storage device of the controller. In a case in which the correction information stored in the memory circuit includes a predetermined value, the controller determines not to rewrite regardless of a result in which the controller determines to rewrite based on the correction information stored in the memory circuit and one of the correction information and the predetermined calculation result stored in the storage device of the controller.

With this configuration, as described above with reference to Case No. 3 of TABLE 1 as an example, in a case in which only the development unit is replaced, the correction information or the calculation result stored in the storage device of the main body of the image forming apparatus is prevented from getting rewritten with an improper value.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

a process unit detachably attachable relative to a main body of the image forming apparatus, the process unit including, as a single integrated unit, a latent image bearing member to bear a latent image on a surface thereof, a charging device to charge the surface of the latent image bearing member, and a development device to develop the latent image on the surface of the latent image bearing member with toner to form a toner image;

a latent image writer to write the latent image on the surface of the latent image bearing member charged by the charging device;

a power source to output a charging bias supplied to the charging device;

a process-unit detector to detect detachment and attachment of the process unit relative to the main body of the image forming apparatus; and a controller operatively connected to the power source to cause the power source to output the charging bias at a predetermined target level, the process unit further including a first storage device to store correction information for calculating the predetermined target level of the charging bias in accordance with a combination of the latent image bearing member and the charging device, the controller correcting the predetermined target level based on the correction information stored in the first storage device, wherein the controller includes a second storage device, and based on detection of detachment and attachment of the process unit by the process unit detector the controller reads the correction information from the first storage device and stores in the second storage device one of the correction information read from the first storage device and a predetermined calculation result based on the correction information to correct the predetermined target level of the charging bias.

2. The image forming apparatus according to claim 1, wherein the first storage device stores individual identification information of the process unit, and based on detection of detachment and attachment of the process unit by the process unit detector the controller reads the individual identification information from the first storage device and stores the individual identification information in the second storage device.

3. The image forming apparatus according to claim 1, wherein upon detection of detachment and attachment of the process unit by the process unit detector, based on the correction information stored in the first storage device and one of the correction information and the predetermined calculation result stored in the second storage device the controller determines whether or not to rewrite one of the correction information and the predetermined calculation result stored in the second storage device with a value corresponding to the correction information stored in the first storage device.

4. The image forming apparatus according to claim 3, wherein the process unit separably includes an image bearer unit including the latent image bearing member and the charging device, and a development unit including the development device and a toner density detector including a memory circuit as the first storage device to detect a toner density of a development agent in the development device.

5. The image forming apparatus according to claim 4, wherein in a case in which the correction information stored in the memory circuit includes a predetermined value, the controller determines not to rewrite regardless of a result in which the controller determines to rewrite based on the correction information stored in the memory circuit and one of the correction information and the predetermined calculation result stored in the second storage device.

6. The image forming apparatus according to claim 5, further comprising an input device operated by a user to input data for rewriting one of the correction information and the predetermined calculation result stored in the second storage device.

7. The image forming apparatus according to claim 6, wherein the image bearer unit includes a casing, and one of the correction information and the predetermined calculation result is coded and attached visibly to the casing.

8. The image forming apparatus according to claim 5, wherein the memory circuit stores a sum of a regular correction value and a predetermined constant, and the second storage device stores the correction information read from the memory circuit and converted to the regular correction value by substituting the predetermined constant.

9. An image forming apparatus, comprising:

a process unit detachably attachable relative to a main body of the image forming apparatus, the process unit separably including, as a single integrated unit, an image bearer unit including a latent image bearing member to bear a latent image on a surface thereof and a charging device to charge the surface of the latent image bearing member, and a development unit including a development device to develop the latent image on the surface of the latent image bearing member with toner to form a toner image and a toner density detector to detect a toner density of a development agent in the development device, the toner density detector including a memory circuit to store correction information for correcting a target charging bias in accordance with the process unit;

a latent image writer to write the latent image on the surface of the latent image bearing member charged by the charging device;

a power source to output a charging bias supplied to the charging device; and a controller operatively connected to a predetermined device associated with a predetermined control parameter based on a target value of the predetermined control parameter, wherein in a case in which the process unit is detached from and attached to the main body of the image forming apparatus, the controller determines whether or not to rewrite one of the correction information and the predetermined calculation result stored in a storage device of the main body of the image forming apparatus with a value stored in the memory circuit of the toner density detector based on the correction information stored in the memory circuit and one of the correction information and a predetermined calculation result based on the correction information stored in a storage device of the controller, wherein in a case in which the correction information stored in the memory circuit includes a predetermined value, the controller determines not to rewrite regardless of a result in which the controller determines to rewrite based on the correction information stored in the memory circuit and one of the correction information and the predetermined calculation result stored in the storage device of the controller.

* * * * *